US009672840B2

(12) United States Patent
Lee et al.

(10) Patent No.: US 9,672,840 B2
(45) Date of Patent: Jun. 6, 2017

(54) METHOD FOR ENCODING VOICE SIGNAL, METHOD FOR DECODING VOICE SIGNAL, AND APPARATUS USING SAME

(71) Applicant: LG Electronics Inc., Seoul (KR)

(72) Inventors: Younghan Lee, Seoul (KR); Gyuhyeok Jeong, Seoul (KR); Ingyu Kang, Seoul (KR); Hyejeong Jeon, Seoul (KR); Lagyoung Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 38 days.

(21) Appl. No.: 14/353,981

(22) PCT Filed: Oct. 29, 2012

(86) PCT No.: PCT/KR2012/008947
§ 371 (c)(1),
(2) Date: Apr. 24, 2014

(87) PCT Pub. No.: WO2013/062392
PCT Pub. Date: May 2, 2013

(65) Prior Publication Data

US 2014/0303965 A1 Oct. 9, 2014

Related U.S. Application Data

(60) Provisional application No. 61/552,446, filed on Oct. 27, 2011, provisional application No. 61/709,965, filed on Oct. 4, 2012.

(51) Int. Cl.
*G10L 19/24* (2013.01)
*G10L 21/02* (2013.01)
(Continued)

(52) U.S. Cl.
CPC ..... *G10L 21/02* (2013.01); *G10L 19/002* (2013.01); *G10L 19/005* (2013.01); *G10L 19/025* (2013.01); *G10L 19/24* (2013.01)

(58) Field of Classification Search
CPC ... G10L 19/002; G10L 19/005; G10L 19/025; G10L 19/24; G10L 21/02
See application file for complete search history.

(56) References Cited

U.S. PATENT DOCUMENTS 4,568,234 A 2/1986 Lee
4,949,383 A 8/1990 Koh
(Continued)

FOREIGN PATENT DOCUMENTS

JP 08-204575 A 8/1996
JP 2002268657 A 9/2002
(Continued)

OTHER PUBLICATIONS

Search Report dated May 11, 2015 for corresponding European Patent Application No. 12843449.5, 12 pages.
(Continued)

*Primary Examiner* — Ibrahim Siddo
(74) *Attorney, Agent, or Firm* — Fish & Richardson P.C.

(57) ABSTRACT

The present invention relates to a method for encoding a voice signal, a method for decoding a voice signal, and an apparatus using the same. The method for encoding the voice signal according to the present invention, includes the steps of:

determining an eco-zone in a present frame; allocating bits for the present frame on the basis of the location of the eco-zone; and encoding the present frame using the allocated bits, wherein the step of allocating the bits allocates more bits in the section in which the eco-zone is located than in the section in which the eco-zone is not located.

12 Claims, 15 Drawing Sheets

(51) Int. Cl.

| | |
|---|---|
| ***G10L 19/002*** | (2013.01) |
| ***G10L 19/005*** | (2013.01) |
| ***G10L 19/025*** | (2013.01) |
| ***G10L 19/035*** | (2013.01) |

(56) References Cited

U.S. PATENT DOCUMENTS

| | | | | |
|---|---|---|---|---|
| 5,268,685 | A * | 12/1993 | Fujiwara | H03G 7/007 341/76 |
| 5,311,549 | A * | 5/1994 | Mahieux | 375/342 |
| 6,240,379 | B1 * | 5/2001 | Yin | 704/200.1 |
| 2005/0267756 | A1 | 12/2005 | Schultz | |
| 2008/0097755 | A1 * | 4/2008 | Xie | 704/222 |
| 2008/0154589 | A1 * | 6/2008 | Tsuchinaga | G10L 19/035 704/230 |
| 2009/0313009 | A1 * | 12/2009 | Kovesi | G10L 19/24 704/203 |
| 2010/0268542 | A1 | 10/2010 | Kim | |
| 2011/0194598 | A1 | 8/2011 | Miao | |

FOREIGN PATENT DOCUMENTS

| | | | |
|---|---|---|---|
| JP | 2004004710 | A | 1/2004 |
| JP | 2006502426 | T | 1/2006 |
| JP | 2006224862 | A | 8/2006 |
| JP | 2008102521 | A | 5/2008 |
| JP | 2009527773 | T | 7/2009 |
| KR | 10-1995-009412 | B1 | 8/1995 |
| KR | 10-2008-0103088 | A | 11/2008 |
| KR | 10-2010-0115215 | A | 10/2010 |
| WO | WO2004034379 | A2 | 4/2004 |
| WO | WO2007029304 | A1 | 3/2007 |
| WO | WO 2007/096552 | A2 | 8/2007 |
| WO | WO2007096552 | A2 | 8/2007 |

OTHER PUBLICATIONS

Office Action dated May 26, 2015 for corresponding Japanese Patent Application No. 2014-538772, 4 pages.

International Search Report dated Feb. 27, 2013 for Application No. PCT/KR2012/008947, with English Translation, 4 pages.

Office Action dated Nov. 3, 2015 for corresponding Chinese Application No. 201280063395.9, 10 pages.

* cited by examiner (a)

(b)

(a)

(b)

METHOD FOR ENCODING VOICE SIGNAL, METHOD FOR DECODING VOICE SIGNAL, AND APPARATUS USING SAME

CROSS REFERENCE TO RELATED APPLICATIONS

This application is a U.S. National Phase Application under 35 U.S.C. §371 of International Application PCT/KR2012/008947, filed on Oct. 29, 2012, which claims the benefit of U.S. Provisional Application No. 61/552,446, filed on Oct. 27, 2011, and U.S. Provisional Application No. 61/709,965, filed on Oct. 4, 2012, the entire content of the prior applications is hereby incorporated by reference.

TECHNICAL FIELD

The present invention relates to a technique of processing a voice signal, and more particularly, to a method and a device for variably allocating bits in encoding a voice signal so as to solve a problem with pre-echo.

BACKGROUND ART

With recent development in networks and an increase in user request for high-quality services, a method and a device for encoding/decoding voice signals of from a narrowband to a wideband or a super wideband in communication environments have been developed.

The extension of communication bands means that almost all sound signals up to music and mixed contents as well as voices are included as an encoding target.

Accordingly, an encoding/decoding method based on transform of signals is importantly used.

A restriction in bit rates and a restriction in communication bands are present in code excited linear prediction (CELP) which is mainly used in existing voice encoding/decoding, but low bit rates have provided sound quality sufficient for conversations.

However, with recent development in communication techniques, available bit rates have increased and a high-quality voice and audio encoder has been actively developed. Accordingly, a transform-based encoding/decoding technique has been used as a technique other than the CELP having a restriction in communication bands.

Therefore, a method of using the transform-based encoding/decoding technique in parallel with the CELP or as an additional layer is considered.

SUMMARY OF THE INVENTION

Technical Problem

An object of the present invention is to provide a method and a device for solving a problem with a pre-echo that may occur due to the transform-based encoding (transform encoding).

Another object of the present invention is to provide a method and a device for dividing a fixed frame into a section in which a pre-echo may occur and the other section and adaptively allocating bits.

Still another object of the present invention is to provide a method and a device capable of enhancing encoding efficiency by dividing a frame into predetermined sections and differently allocating bits to the divided sections when a bit rate to be transmitted is fixed.

Solution to Problem

According to an aspect of the present invention, there is provided a voice signal encoding method including the steps of determining an echo zone in a current frame; allocating bits to the current frame on the basis of a position of the echo zone; and encoding the current frame using the allocated bits, wherein the step of allocating the bits includes allocating more bits to a section in which the echo zone is present in the current frame than a section in which the echo zone is not present.

The step of allocating the bits may include dividing the current frame into a predetermined number of sections and allocating more bits to the section in which the echo zone is present than the section in which the echo zone is not present.

The step of determining the echo zone may include determining that the echo zone is present in the current frame if energy levels of a voice signal in the sections are not even when the current frame is divided into the sections. At this time, it may be determined that the echo zone is present in a section in which a transient of an energy level is present when the energy levels of the voice signal in the sections are not even.

The step of determining the echo zone may include determining that the echo zone is present in a current subframe when normalized energy in the current subframe varies over a threshold value from the normalized energy in a previous subframe. At this time, the normalized energy may be calculated by normalization based on a largest energy value out of energy values in the subframes of the current frame.

The step of determining the echo zone may include sequentially searching subframes of the current frame, and determining that the echo zone is present in a first subframe in which normalized energy is greater than a threshold value.

The step of determining the echo zone may include sequentially searching subframes of the current frame, and determining that the echo zone is present in a first subframe in which normalized energy is smaller than a threshold value.

The step of allocating the bits may include dividing the current frame into a predetermined number of sections, and allocating the bits to the sections on the basis of energy levels in the sections and weight values depending on whether the echo zone is present.

The step of allocating the bits may include dividing the current frame into a predetermined number of sections, and allocating the bits using a bit allocation mode corresponding to the position of the echo zone in the current frame out of predetermined bit allocation modes. At this time, information indicating the used bit allocation mode may be transmitted to a decoder.

According to another aspect of the present invention, there is provided a voice signal decoding method including the steps of: obtaining bit allocation information of a current frame; and decoding a voice signal on the basis of the bit allocation information, and the bit allocation information may be information of bit allocation for each section in the current frame.

The bit allocation information may indicate a bit allocation mode used for the current frame in a table in which predetermined bit allocation modes are defined.

The bit allocation information may indicate that bits are differentially allocated to a section in which a transient component is present in the current frame and a section in which the transient component is not present.

Advantageous Effects

According to the present invention, it is possible to provide improved sound quality by preventing or reducing noise based on a pre-echo while maintaining the total bit rate to be constant.

According to the present invention, it is possible to provide improved sound quality by allocating more bits to a section in which a pre-echo may occur to more truly perform encoding in comparison with a section in which noise based on a pre-echo is not present.

According to the present invention, it is possible to more efficiently perform encoding depending on energy by differentially allocating bits in consideration of levels of energy components.

According to the present invention, it is possible to implement high-quality voice and audio communication services by providing the improved sound quality.

According to the present invention, it is possible to provide various additional services by implementing the high-quality voice and audio communication services.

According to the present invention, since occurrence of a pre-echo can be prevented or reduced using even the transform-based voice encoding, it is possible to more effectively utilize the transform-based voice encoding.

DESCRIPTION OF EMBODIMENTS OF THE INVENTION

Hereinafter, embodiments of the invention will be specifically described with reference to the accompanying drawings. When it is determined that detailed description of known configurations or functions involved in the invention makes the gist of the invention obscure, the detailed description thereof will not be made.

If it is mentioned that a first element is "connected to" or "coupled to" a second element, it should be understood that the first element may be directly connected or coupled to the second element and may be connected or coupled to the second element via a third.

Terms such as "first" and "second" can be used to distinguish one element from another element. For example, an element named a first element in the technical spirit of the present invention may be named a second element and may perform the same function.

A large capacity of signal can be processed with development in network techniques and, for example, code-excited linear prediction (CELP)-based encoding/decoding (hereinafter, referred to as "CELP encoding" and "CELP decoding" for the purpose of convenience of explanation) and transform-based encoding/decoding (hereinafter, referred to as "transform encoding" and "transform decoding" for the purpose of convenience of explanation) can be used in parallel to encode/decode a voice signal with an increase in available bits.

Figure 1:
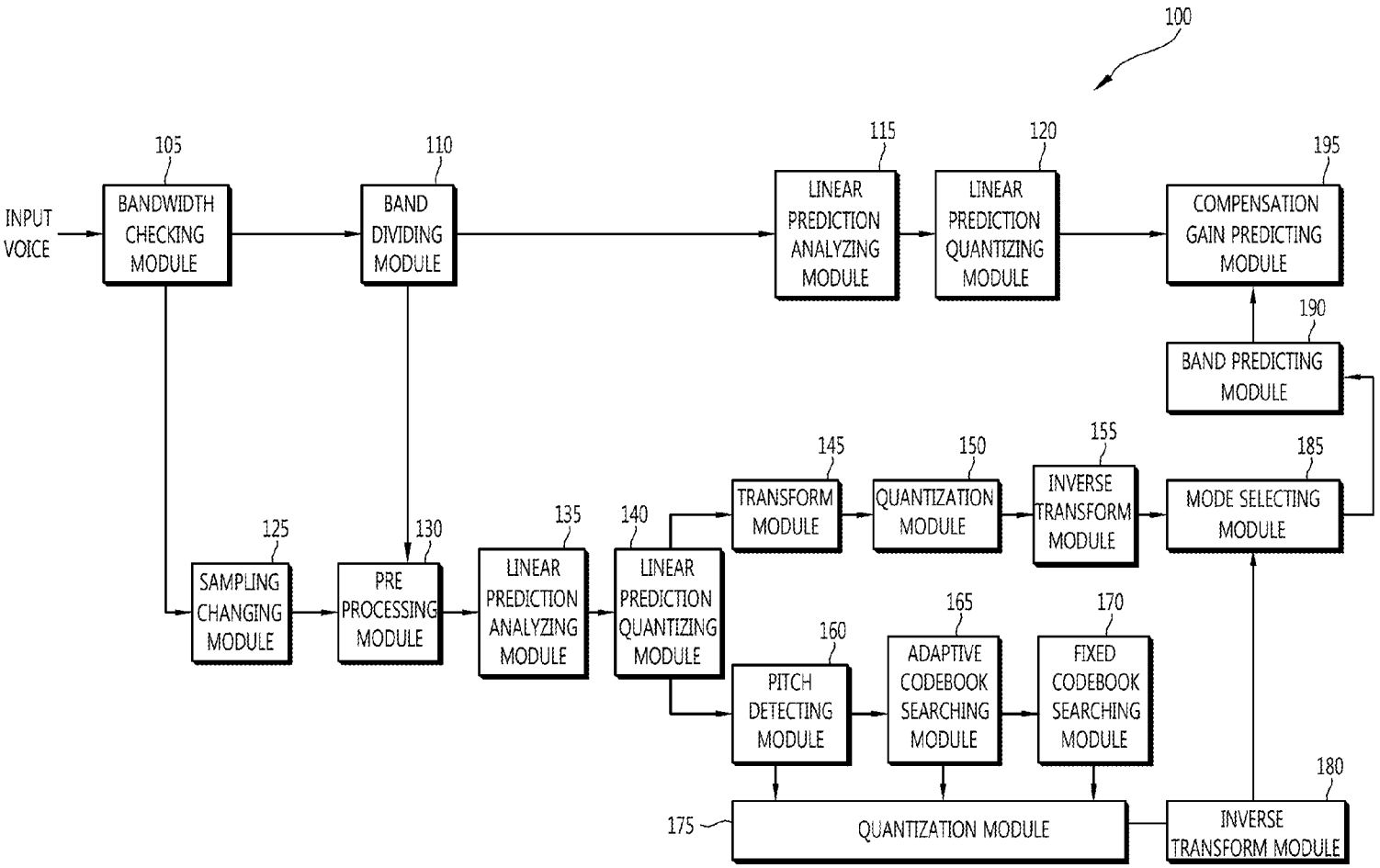
FIGS. 1 and 2 are diagrams schematically illustrating examples of a configuration of an encoder.

FIG. 1 is a diagram schematically illustrating an example of a configuration of an encoder. FIG. 1 illustrates an example where algebraic code-excited linear prediction (ACELP) technique and a transform coded excitation (TCX) technique are used in parallel. In the example illustrated in FIG. 1, a voice and audio signal is transformed to a frequency axis and is then quantized using an algebraic vector quantization (AVQ) technique.

Referring to FIG. 1, a voice encoder 100 includes a bandwidth checking module 105, a sampling changing module 125, a pre-processing module 130, a band dividing module 110, linear-prediction analyzing modules 115 and 135, linear prediction quantizing modules 140, 150, and 175, a transform module 145, inverse transform modules 155 and 180, a pitch detecting module 160, an adaptive codebook searching module 165, a fixed codebook searching module 170, a mode selecting module 185, a band predicting module 190, and a compensation gain predicting module 195.

The bandwidth checking module 105 may determine bandwidth information of an input voice signal. Depending on bandwidths thereof, voice signals can be classified into a narrowband signal which has a bandwidth of about 4 kHz and which is often used in a public switched telephone network (PSTN), a wideband signal which has a bandwidth of about 7 kHz and which is often used in high-quality speech or AM radio which is more natural than the narrowband voice signal, and a super-wideband signal which has a bandwidth of about 14 kHz and which is often used in the fields in which sound quality is emphasized such as music and digital broadcast. The bandwidth checking module 105 may transform the input voice signal to a frequency domain and may determine whether the current voice signal is a narrowband signal, a wideband signal, or a super-wideband signal. The bandwidth checking module 105 may transform the input voice signal to the frequency domain and may check and determine presence and/or components of upper-band bins of a spectrum. The bandwidth checking module 105 may not be provided separately in some cases where the bandwidth of an input voice signal is fixed.

The bandwidth checking module 105 may transmit the super-wideband signal to the band dividing module 110 and may transmit the narrowband signal or the wideband signal to the sampling changing module 125, depending on the bandwidth of the input voice signal.

The band dividing module 110 may change the sampling rate of the input signal and divide the input signal into an upper band and a lower band. For example, a voice signal of 32 kHz may be changed to a sampling frequency of 25.6 kHz and may be divided into the upper band and the lower band by 12.8 kHz. The band dividing module 110 transmits the lower-band signal of the divided bands to the pre-processing module 130 and transmits the upper-band signal to the linear prediction analyzing module 115.

The sampling changing module 125 may receive an input narrowband signal or an input wideband signal and may change a predetermined sampling rate. For example, when the sampling rate of the input narrowband signal is 8 kHz, the input narrowband voice signal may be up-sampled to 12.8 kHz to generate an upper-band signal. When the sampling rate of the input wideband voice signal is 16 kHz, the input wideband voice signal may be down-sampled to 12.8 kHz to generate a lower-band signal. The sampling changing module 125 outputs the lower-band signal of which the sampling rate has been changed. The internal sampling frequency may be a sampling frequency other than 12.8 kHz.

The pre-processing module 130 pre-processes the lower-band signal output from the sampling changing module 125 and the band dividing module 110. The pre-processing module 130 filters the input signal so as to efficiently extract voice parameters. The parameters may be extracted from important bands by differently setting the cutoff frequency depending on voice bandwidths and high-pass filtering very low frequencies which are frequency bands in which less important information gathers. In another example, an energy level in a low-frequency region and an energy level a high-frequency region may be scaled by boosting the high-frequency bands of the input signal using pre-emphasis filtering. Accordingly, it is possible to increase a resolution in linear prediction analysis.

The linear prediction analyzing modules 115 and 135 may calculate linear prediction coefficients (LPCs). The linear prediction analyzing modules 115 and 135 may model a formant indicating the entire shape of a frequency spectrum of a voice signal. The linear prediction analyzing modules 115 and 135 may calculate the LPC values so that the mean square error (MSE) of error values which are differences between an original voice signal and a predicted voice signal generated using the linear prediction coefficients calculated by the linear prediction analyzing module 135. Various methods such as an autocorrelation method and a covariance method may be used to calculate the LPCs.

The linear prediction analyzing module 115 may extract low-order LPCs unlike the linear prediction analyzing module 135 for a lower-band signal.

The linear prediction quantizing modules 120 and 140 may transform the extracted LPCs to generate transform coefficients in the frequency domain such as linear spectral pairs (LSPs) or linear spectral frequencies (LSFs) and may quantize the generated transform coefficients in the frequency domain. An LPC has a large dynamic range. Accordingly, when the LPCs are transmitted without any change, a lot of bits is required. Therefore, the LPC information may be transmitted with a small amount of bits (a small degree of compression) by transforming the transform coefficients to the frequency domain and quantizing the transform coefficients.

The linear prediction quantizing modules 120 and 140 may generate a linear prediction residual signal using the LPCs obtained by dequantizing and transforming the quantized LPCs to the time domain. The linear prediction residual signal may be a signal in which the predicted formant component is removed from the voice signal and may include pitch information and a random signal.

The linear prediction quantizing module 120 generates a linear prediction residual signal by filtering the original upper-band signal using the quantized LPCs. The generated linear prediction residual signal is transmitted to the compensation gain predicting module 195 so as to calculate a compensation gain with the upper-band prediction excitation signal.

The linear prediction quantizing module 140 generates a linear prediction residual signal by filtering the original lower-band signal using the quantized LPCs. The generated linear prediction residual signal is input to the transform module 145 and the pitch detecting module 160.

In FIG. 1, the transform module 145, the quantization module 150, and the inverse transform module 155 may serve as a TCX mode executing module that executes a transform coded excitation (TCX) mode. The pitch detecting module 160, the adaptive codebook searching module 165, and the fixed codebook searching module 170 may serve as a CELP mode executing module that executes a code-excited linear prediction (CELP) mode.

The transform module 145 may transform the input linear prediction residual signal to the frequency domain on the basis of a transform function such as a discrete Fourier transform (DFT) or a fast Fourier transform (FFT). The transform module 145 may transmit transform coefficient information to the quantization module 150.

The quantization module 150 may quantize the transform coefficients generated by the transform module 145. The quantization module 150 may perform quantization using various methods. The quantization module 150 may selectively perform the quantization depending on frequency bands and may calculate an optimal frequency combination using a analysis-by-synthesis (AbS) method.

The inverse transform module 155 may perform inverse transform on the basis of the quantized information to generate a reconstructed excitation signal of the linear prediction residual signal in the time domain.

The linear prediction residual signal quantized and then inversely transformed, that is, the reconstructed excitation signal, is reconstructed as a voice signal through the linear prediction. The reconstructed voice signal is transmitted to the mode selecting module 185. In this way, the voice signal reconstructed in the TCX mode may be compared with a voice signal quantized and reconstructed in the CELP mode to be described later.

On the other hand, in the CELP mode, the pitch detecting module 160 may calculate pitches of the linear prediction residual signal using an open-loop method such as an autocorrelation method. For example, the pitch detecting module 160 may compare the synthesized voice signal with the actual voice signal and may calculate the pitch period and the peak value. The AbS method or the like may be used at this time.

The adaptive codebook searching module 165 extracts an adaptive codebook index and a gain on the basis of the pitch information calculated by the pitch detecting module. The adaptive codebook searching module 165 may calculate a pitch structure form the linear prediction residual signal on the basis of the adaptive codebook index and the gain using the AbS method or the like. The adaptive codebook searching module 165 transmits the contribution of the adaptive codebook, for example, the linear prediction residual signal from which the information on the pitch structure is excluded to the fixed codebook searching module 170.

The fixed codebook searching module 170 may extract and encode a fixed codebook index and a gain on the basis of the linear prediction residual signal received from the adaptive codebook searching module 165. At this time, the linear prediction residual signal used to extract the fixed codebook index and the gain by the fixed codebook searching module 170 may be a linear prediction residual signal from which the information on the pitch structure is excluded.

The quantization module 175 quantizes the parameters such as the pitch information output from the pitch detecting module 160, the adaptive codebook index and the gain output from the adaptive codebook searching module 165, and the fixed codebook index and the gain output from the fixed codebook searching module 170.

The inverse transform module 180 may generate an excitation signal as the reconstructed linear prediction residual signal using the information quantized by the quantization module 175. A voice signal may be reconstructed through the reverse processes of the linear prediction on the basis of the excitation signal.

The inverse transform module 180 transmits the voice signal reconstructed in the CELP mode to the mode selecting module 185.

The mode selecting module 185 may compare the TCX excitation signal reconstructed in the TCX mode and the CELP excitation signal reconstructed in the CELP mode and may select a signal more similar to the original linear prediction residual signal. The mode selecting module 185 may also encode information on in what mode the selected excitation signal is reconstructed. The mode selecting module 185 may transmit the selection information on the selection of the reconstructed voice signal and the excitation signal to the band predicting module 190.

The band predicting module 190 may generate a prediction excitation signal of an upper band using the selection information and the reconstructed excitation signal transmitted from the mode selecting module 185.

The compensation gain predicting module 195 may compare the upper-band prediction excitation signal transmitted from the band predicting module 190 and the upper-band prediction residual signal transmitted from the linear prediction quantizing module 120 and may compensate for a gain in a spectrum.

On the other hand, the constituent modules in the example illustrated in FIG. 1 may operate as individual modules or plural constituent modules may operate as a single module. For example, the quantization modules 120, 140, 150, and 175 may perform the operations as a single module or the quantization modules 120, 140, 150, and 175 may be disposed at positions necessary in processes as individual modules.

Figure 2:
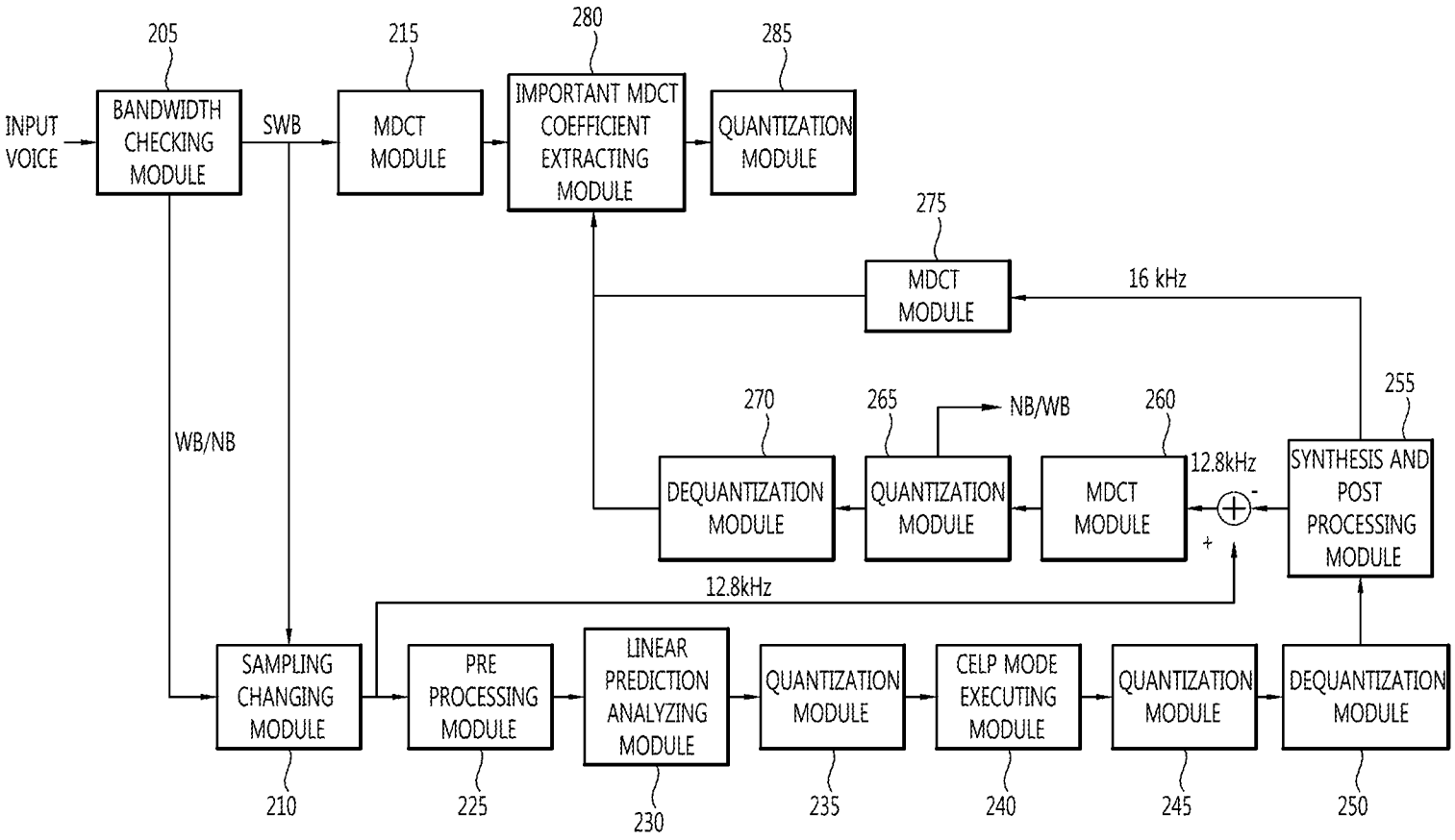

FIG. 2 is a diagram schematically illustrating another example of the configuration of the encoder. FIG. 2 illustrates an example where the excitation signal subjected to an ACELP encoding technique is transformed to the frequency axis using a modified discrete cosine transform (MDCT) method and is quantized using a band selective-shape gain coding (BS-SGC) method or a factorial pulse coding (FPC) method.

Referring to FIG. 2, a bandwidth checking module 205 may determine whether an input signal (voice signal) is a narrowband (NB) signal, a wideband (WB) signal, or a super-wideband (SWB) signal. The NB signal has a sampling rate of 8 kHz, the WB signal has a sampling rate of 16 kHz, and the SWB signal has a sampling rate of 32 kHz.

The bandwidth checking module 205 may transform the input signal to the frequency domain and may determine components and presence of upper-band bins in a spectrum.

The encoder 300 may not include the bandwidth checking module 205 when the input signal is fixed, for example, when the input signal is fixed to a NB signal.

The bandwidth checking module 205 determines the type of the input signal, outputs the NB signal or the WB signal to the sampling changing module 210, and outputs the SWB signal to the sampling changing module 210 or the MDCT module 215.

The sampling changing module 210 performs a sampling process of converting the input signal to the WB signal to be input to a core encoder 220. For example, the sampling changing module 210 up-samples the input signal to a sampling rate of 12.8 kHz when the input signal is an NB signal, and down-samples the input signal to a sampling rate of 12.8 kHz when the input signal is a WB signal, thereby generating a lower-band signal of 12.8 kHz. When the input signal is a SWB signal, the sampling changing module 210 down-samples the input signal to a sampling rate of 12.8 kHz to generate an input signal of the core encoder 220.

The pre-processing module 225 may filter lower-frequency components out of lower-band signals input to the core encoder 220 and may transmit only the signals of a desired band to the linear prediction analyzing module.

The linear prediction analyzing module 230 may extract linear prediction coefficients (LPCs) from the signals processed by the pre-processing module 225. For example, the linear prediction analyzing module 230 may extract sixteenth-order linear prediction coefficients from the input signals and may transmit the extracted sixteenth-order linear prediction coefficients to the quantization module 235.

The quantization module 235 quantizes the linear prediction coefficients transmitted from the linear prediction analyzing module 230. The linear prediction residual signal is generated by applying filtering using the original lower-band signal to the linear prediction coefficients quantized in the lower band.

The linear prediction residual signal generated by the quantization module 235 is input to the CELP mode executing module 240.

The CELP mode executing module 240 detects pitches of the input linear prediction residual signal using an autocorrelation function. At this time, methods such as a first-order open-loop pitch searching method, a first-order closed loop pitch searching method, and an AbS method may be used.

The CELP mode executing module 240 may extract an adaptive codebook index and a gain on the basis of the information of the detected pitches. The CELP mode executing module 240 may extract a fixed codebook index and a gain on the basis of the other components of the linear prediction residual signal other than the contribution of the adaptive codebook.

The CELP mode executing module 240 transmits the parameters (such as the pitches, the adaptive codebook index and the gain, and the fixed codebook index and the gain) of the linear prediction residual signal extracted through the pitch search, the adaptive codebook search, and the fixed codebook search to a quantization module 245.

The quantization module 245 quantizes the parameters transmitted from the CELP mode executing module 240.

The parameters of the linear prediction residual signal quantized by the quantization module 245 may be output as a bitstream and may be transmitted to the decoder. The parameters of the linear prediction residual signal quantized by the quantization module 245 may be transmitted to a dequantization module 250.

The dequantization module 250 generates a reconstructed excitation signal using the parameters extracted and quantized in the CELP mode. The generated excitation signal is transmitted to a synthesis and post-processing module 255.

The synthesis and post-processing module 255 synthesizes the constructed excitation signal and the quantized linear prediction coefficients to generate a synthesis signal of 12.8 kHz and reconstructs a WB signal of 16 kHz through the up-sampling.

A difference signal between the signal (12.8 kHz) output from the synthesis and post-processing module 255 and the lower-band signal sampled with a sampling rate of 12.8 kHz by the sampling changing module 210 is input to a MDCT module 260.

The MDCT module 260 transforms the difference signal between the signal output from the sampling changing module 210 and the signal output from the synthesis and post-processing module 255 using the MDCT method.

A quantization module 265 may quantize the signal subjected to the MDCT using the SGC or the FPC and may output a bitstream corresponding to the narrow band or the wide band.

A dequantization module 270 dequantizes the quantized signal and transmits the lower-band enhanced layer MDCT coefficients to an important MDCT coefficient extracting module 280.

The important MDCT coefficient extracting module 280 extracts the transform coefficients to be quantized using the MDCT coefficients input from the MDCT module 275 and the dequantization module 270.

A quantization module 285 quantizes and outputs the extracted MODCT coefficients as a bitstream corresponding to a super-wideband signal.

Figure 3:
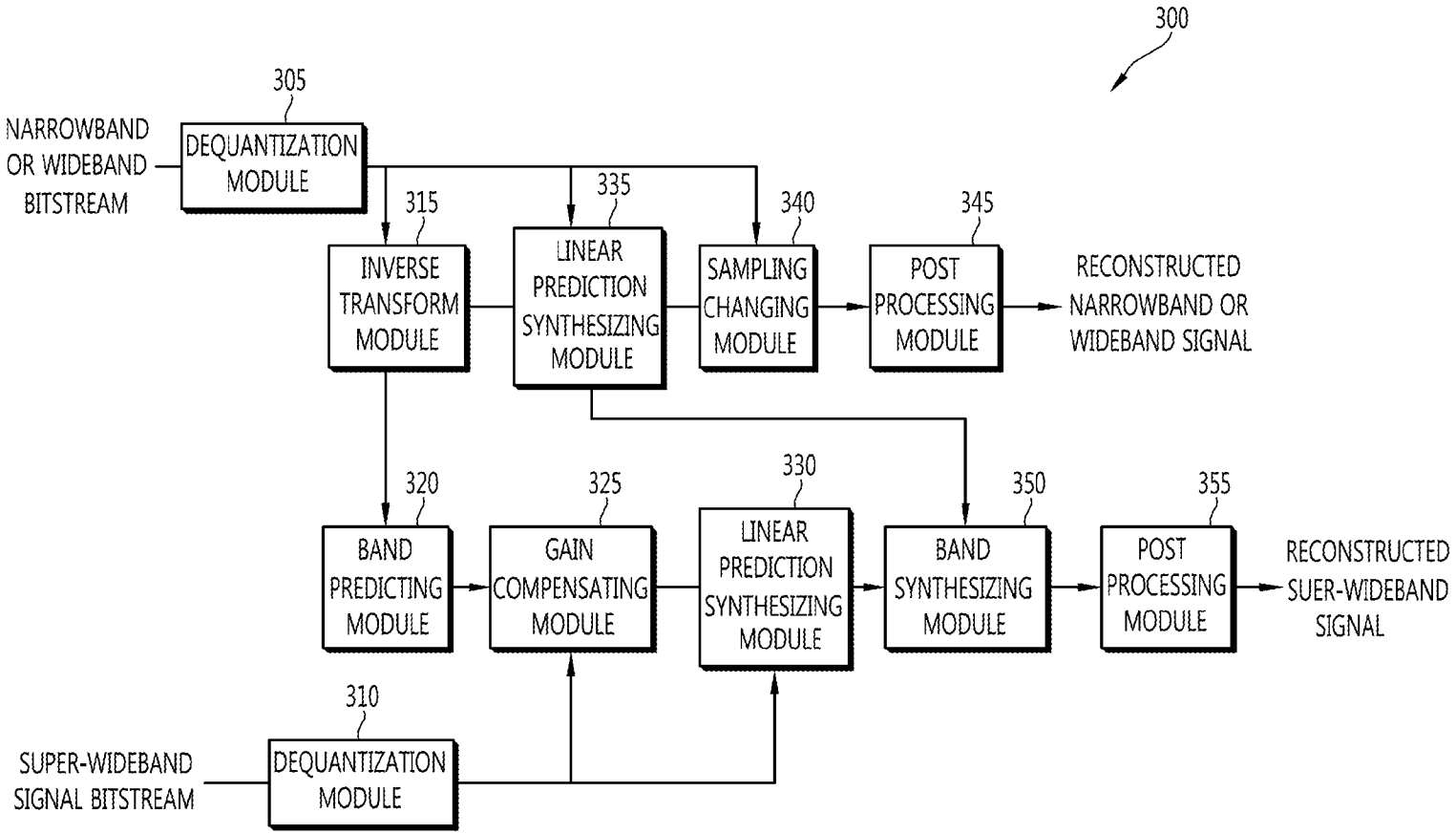
FIGS. 3 and 4 are diagrams schematically illustrating examples of a decoder corresponding to the encoder illustrated in FIGS. 1 and 2.

FIG. 3 is a diagram schematically illustrating an example of a voice decoder corresponding to the voice encoder illustrated in FIG. 1.

Referring to FIG. 3, the voice decoder 300 includes dequantization modules 305 and 310, a band predicting module 320, a gain compensating module 325, an inverse transform module 315, linear prediction synthesizing modules 330 and 335, a sampling changing module 340, a band synthesizing module 350, and post-processing filtering modules 345 and 355.

The dequantization modules 305 and 310 receive quantized parameter information from the voice encoder and dequantize the received information.

The inverse transform module 315 may inversely transform TCX-encoded or CELP-encoded voice information and may reconstruct an excitation signal. The dequantization module 315 may generate the reconstructed excitation signal on the basis of the parameters received from the voice encoder. At this time, the dequantization module 315 may perform the inverse transform only on some bands selected by the voice encoder. The inverse transform module 315 may transmit the reconstructed excitation signal to the linear prediction synthesizing module 335 and the band predicting module 320.

The linear prediction synthesizing module 335 may reconstruct a lower-band signal using the excitation signal transmitted from the inverse transform module 315 and the linear prediction coefficients transmitted from the voice encoder. The linear prediction synthesizing module 335 may transmit the reconstructed lower-band signal to the sampling changing module 340 and the band synthesizing module 350.

The band predicting module 320 may generate an upper-band predicted excitation signal on the basis of the reconstructed excitation signal received from the inverse transform module 315.

The gain compensating module 325 may compensate for a gain in a spectrum of a super-wideband voice signal on the basis of the upper-band predicted excitation signal value received from the band predicting module 320 and the compensation gain value transmitted from the voice encoder.

The linear prediction synthesizing module 330 may receive the compensated upper-band predicted excitation signal form the gain compensating module 325 and may reconstruct an upper-band signal on the basis of the compensated upper-band predicted excitation signal value and the linear prediction coefficient values received from the voice encoder.

The band synthesizing module 350 may receive the reconstructed lower-band signal from the linear prediction synthesizing module 335, may receive the reconstructed upper-band signal from the linear prediction synthesizing module 330, and may perform band synthesization on the received upper-band signal and the received lower-band signal.

The sampling changing module 340 may transform the internal sampling frequency value to the original sampling frequency value.

The post-processing modules 345 and 355 may perform a post-processing operation necessary for reconstructing a signal. For example, the post-processing modules 345 and 355 may include a de-emphasis filter that can inversely filter the pre-emphasis filter in the pre-processing module. The post-processing modules 345 and 355 may perform various post-processing operations such as an operation of minimizing a quantization error and an operation of reviving harmonic peaks of a spectrum and suppressing valleys thereof as well as the filtering operation. The post-processing module 345 may output the reconstructed narrowband or wideband signal and the post-processing module 355 may output the reconstructed super-wideband signal.

Figure 4:
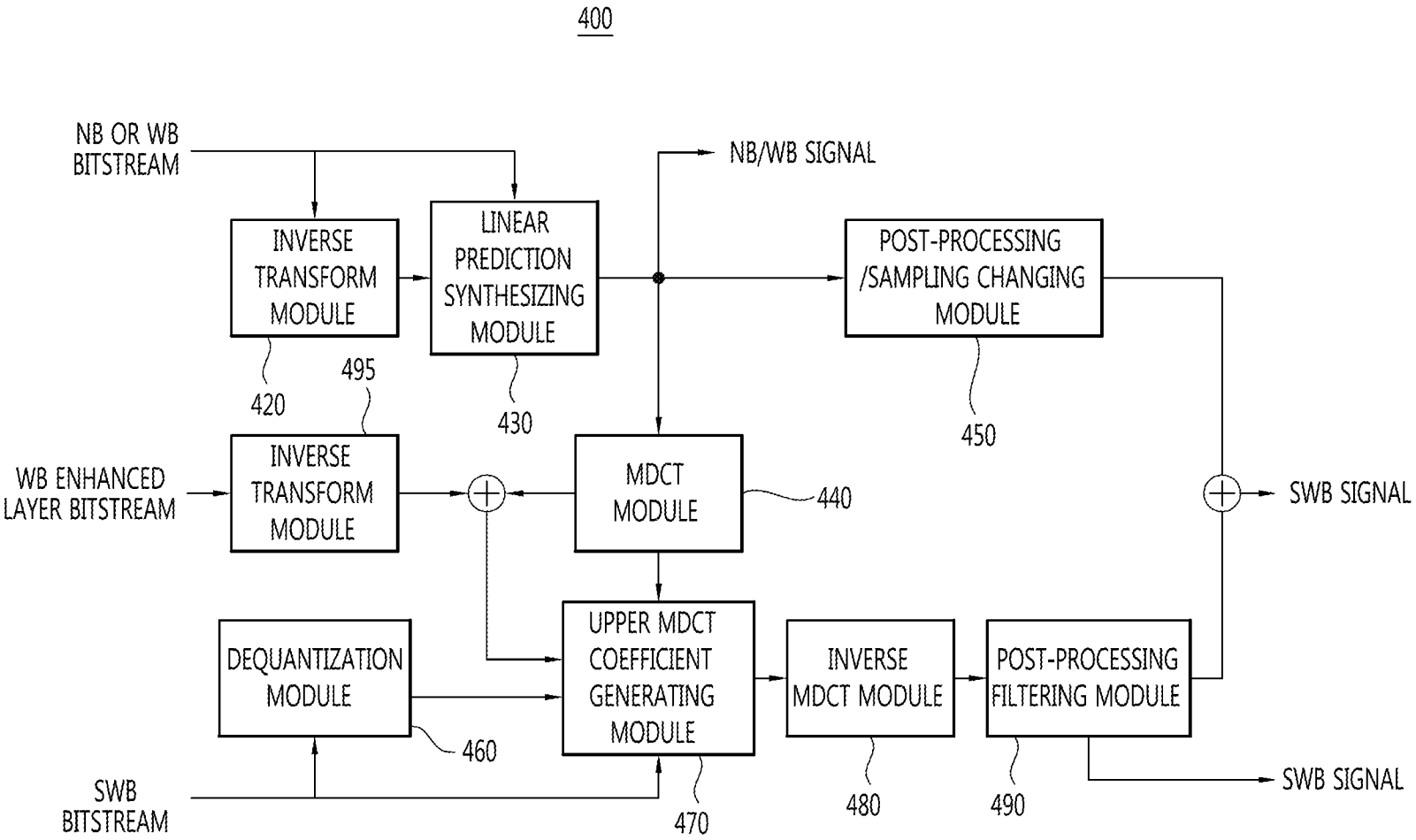

FIG. 4 is a diagram schematically illustrating an example of a configuration of a voice decoder corresponding to the voice encoder illustrated in FIG. 2.

Referring to FIG. 4, the bitstream including the NB signal or the WB signal transmitted from the voice encoder is input to an inverse transform module 420 and a linear prediction synthesizing module 430.

The inverse transform module 420 may inversely transform CELP-encoded voice information and may reconstruct an excitation signal on the basis of the parameters received from the voice encoder. The inverse transform module 420 may transmit the reconstructed excitation signal to the linear prediction synthesizing module 430.

The linear prediction synthesizing module 430 may reconstruct a lower-band signal (such as a NB signal or a WB signal) using the excitation signal transmitted from the inverse transform module 420 and the linear prediction coefficients transmitted from the voice encoder.

The lower-band signal (12.8 kHz) reconstructed by the linear prediction synthesizing module 430 may be down-sampled to the NB or up-sampled to the WB. The WB signal is output to a post-processing/sampling changing module 450 or to an MDCT module 440. The reconstructed lower-band signal (12.8 kHz) is output to the MDCT module 440.

The post-processing/sampling changing module 450 may filter the reconstructed signal. The post-processing operations such as reducing a quantization error, emphasizing a peak, and suppressing a valley may be performed using the filtering.

The MDCT module 440 transforms the reconstructed lower-band signal (12.8 kHz) and the up-sampled WB signal (16 kHz) in an MDCT manner and transmits the resultant signals to an upper MDCT coefficient generating module 470.

An inverse transform module 495 receives a NB/WB enhanced layer bitstream and reconstructs MDCT coefficients of an enhanced layer. The MDCT coefficients reconstructed by the inverse transform module 495 are added to the output signal of the MDCT module 440 and the resultant signal is input to the upper MDCT coefficient generating module 470.

A dequantization module 460 receives the quantized SWB signal and the parameters through the use of the bitstream from the voice encoder and dequantizes the received information.

The dequantized SWB signal and parameters are transmitted to the upper MDCT coefficient generating module 470.

The upper MDCT coefficient generating module 470 receives the MDCT coefficients of the synthesized 12.8 kHz signal or the WB signal from a core decoder 410, receives necessary parameters from the bitstream of the SWB signal, and generates the MDCT coefficients of the dequantized SWB signal. The upper MDCT coefficient generating module 470 may apply a generic mode or a sinusoidal mode depending on the tonality of the signal and may apply an additional sinusoidal mode to the signal of an extended layer.

An inverse MDCT module 480 reconstructed a signal through inverse transform of the generated MDCT coefficients.

A post-processing filtering module 490 may perform a filtering operation on the reconstructed signal. The post-processing operations such as reducing a quantization error, emphasizing a peak, and suppressing a valley may be performed using the filtering.

The signal reconstructed by the post-processing filtering module 490 and the signal reconstructed by the post-processing/sampling changing module 450 may be synthesized to reconstruct a SWB signal.

On the other hand, the transform encoding/decoding technique has high compression efficiency for a stationary signal. Accordingly, when there is a margin in the bit rate, it is possible to provide a high-quality voice signal and a high-quality audio signal.

However, in the encoding method (transform encoding) using the frequency domain through transform, pre-echo noise may occur unlike the encoding performed in the time domain.

A pre-echo means that noise is generated due to transform for encoding in a soundless area in an original signal. The pre-echo is generated because the encoding is performed in the unit of frames having a constant size for transform to the frequency domain in the transform encoding.

Figure 5:
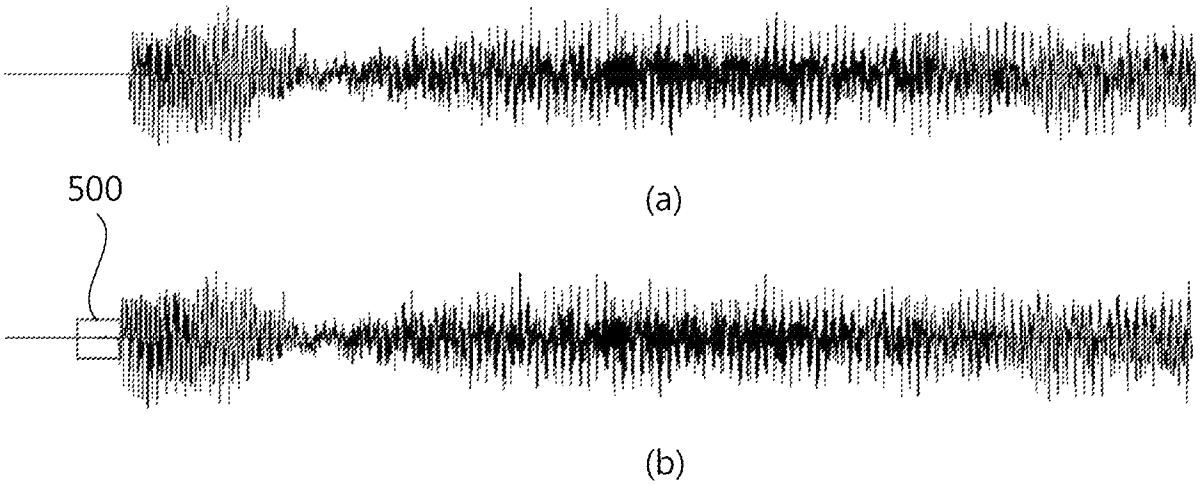
FIGS. 5 and 6 are diagrams schematically illustrating a pre-echo.

FIG. 5 is a diagram schematically illustrating an example of a pre-echo.

FIG. 5(*a*) illustrates an original signal and FIG. 5(*b*) illustrates a reconstructed signal obtained by decoding a signal encoded using the transform encoding method.

As illustrated in the drawings, it can be seen that a signal not appearing in the original signal illustrated in FIG. 5(*a*), that is, noise 500, appears in the transform-encoded signal illustrated in FIG. 5(*b*).

Figure 6:
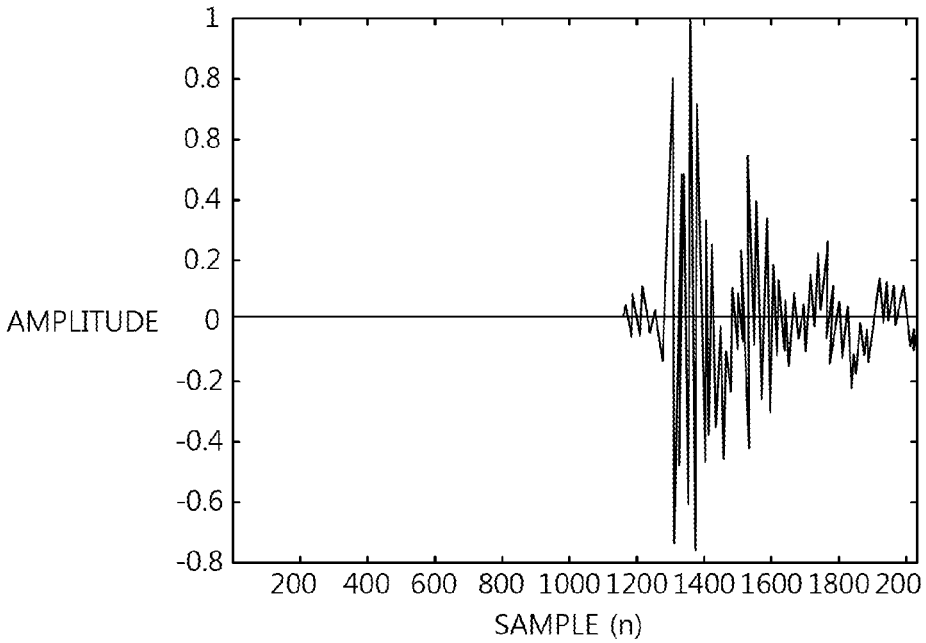
Figure 6:
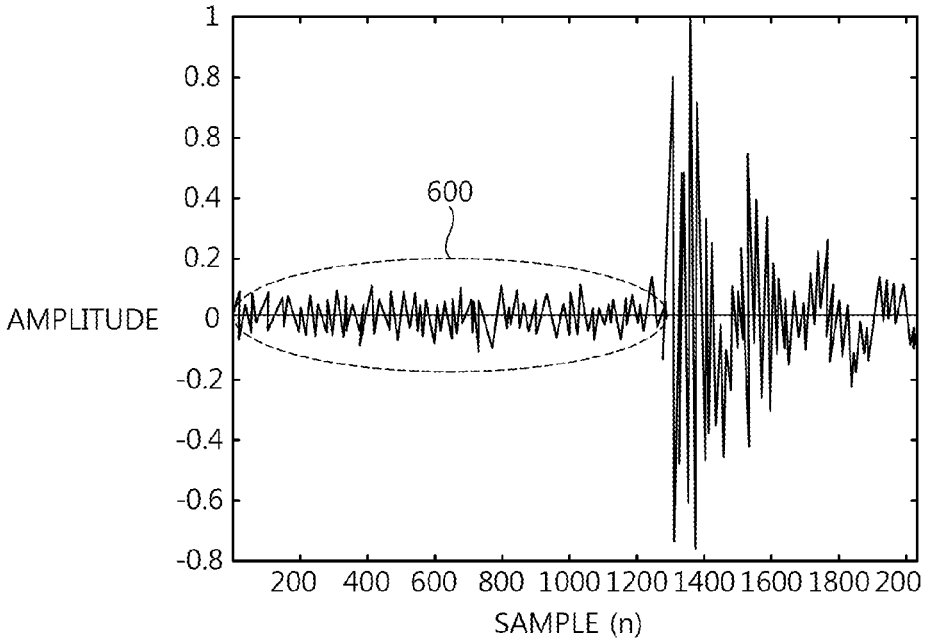

FIG. 6 is a diagram schematically illustrating another example of a pre-echo.

FIG. 6(*a*) illustrates an original signal and FIG. 6(*b*) illustrates a reconstructed signal obtained by decoding a signal encoded using the transform encoding method.

Referring to FIG. 6, the original signal illustrated in FIG. 6(*a*) has no signal corresponding to a voice in the first half of a frame and signals are concentrated on the second half of the frame.

When the signal illustrated in FIG. 6(*a*) is quantized in the frequency domain, quantization noise is present for each frequency component along the frequency axis but is present over the whole frame along the time axis.

When the original signal is present along the time axis in the time domain, the quantization noise may be hidden by the original signal and may not be audible. However, when the original signal is not present as in the first half of the frame illustrated in FIG. 6(*a*), noise, that is, pre-echo distortion 600 is not hidden.

That is, in the frequency domain, since quantization noise is present for each component along the frequency axis, the quantization noise may be hidden by the corresponding component. However, in the time domain, since the quantization noise is present over the whole frame, noise may be exposed in a soundless section along the time axis.

Since the quantization noise due to transform, that is, the pre-echo (quantization) noise, may cause degradation in sound quality, it is necessary to perform a process for minimizing the quantization noise.

In the transform encoding, artifacts known as the pre-echo are generated in a section in which the signal energy rapidly increases. The rapid increase in the signal energy often appears in the onset of a voice signal or the percussions of music.

The pre-echo appears along the time axis when the quantization error along the frequency axis is inversely transformed and then subjected to an overlap-addition process. The quantization noise is uniformly spread over the whole synthesis window at the time of inverse transform.

In case of the onset, the energy in a part in which an analysis frame is started is much smaller than the energy in a part in which the analysis frame is ended. Since the quantization noise is dependent on the average energy of a frame, the quantization noise appears along the time axis over the whole synthesis window.

In a part having small energy, the signal-to-noise ratio is very small and thus the quantization noise is audible to a person's ears when the quantization noise is present. In order to prevent this problem, it is possible to reduce the influence of the quantization noise, that is, the pre-echo, by decreasing the signals in the part in which the energy rapidly increases in the synthesis window.

At this time, an area having small energy in a frame in which the energy rapidly varies, that is, an area in which a pre-echo may appear, is referred to as an echo zone.

In order to prevent the pre-echo, a block switching method or a temporal noise shaping (TNS) method may be used. In the block switching method, the pre-echo is prevented by variably adjusting the frame length. In the TNS method, the pre-echo is prevented on the basis of time-frequency duality of the linear prediction coding (LPC) analysis.

Figure 7:
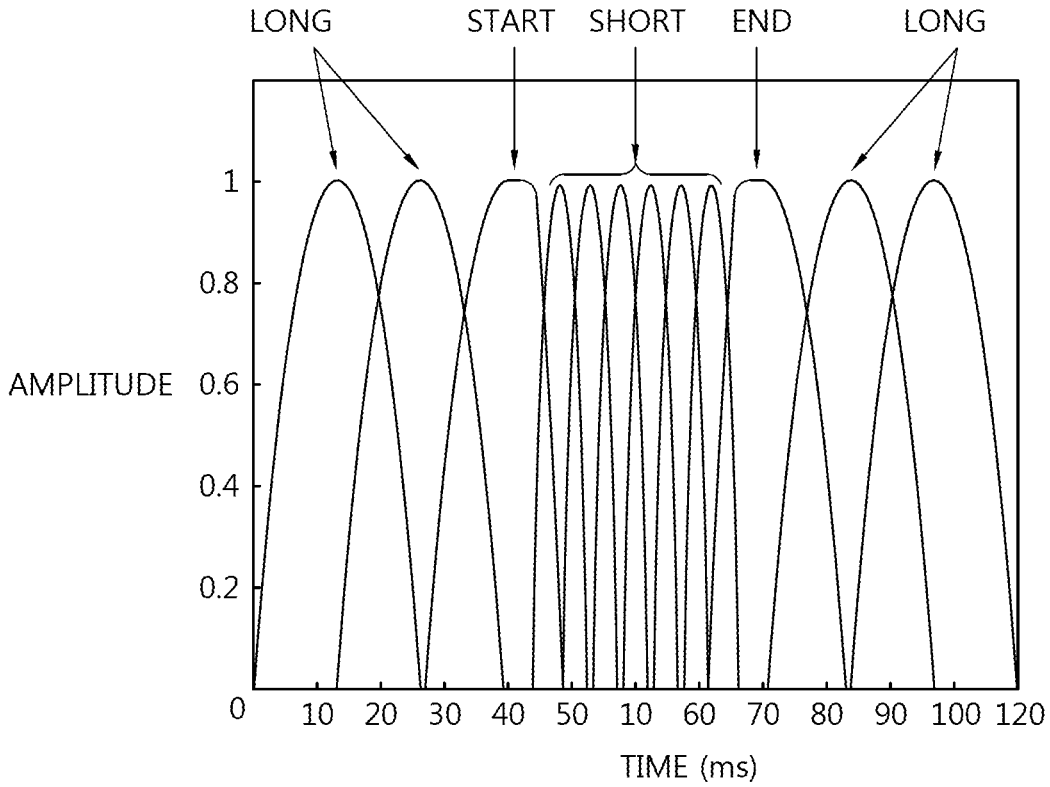
FIG. 7 is a diagram schematically illustrating a block switching method.

FIG. 7 is a diagram schematically illustrating the block switching method.

In the block switching method, the frame length is variably adjusted. For example, as illustrated in FIG. 7, a window includes long windows and short windows.

In a section in which a pre-echo does not appear, the long windows are applied to increase the frame length and then the encoding is performed thereon. In a section in which a pre-echo appears, the short windows are applied to decrease the frame length and then the encoding is performed thereon.

Accordingly, even when a pre-echo appears, the short windows having a short length are used in the corresponding area and thus sections in which noise due to the pre-echo appears decreases in comparison with a case where the long windows are used.

When the block switching method is used and the short windows are used, the sections in which the pre-echo appears can decrease but it is difficult to completely remove the noise due to the pre-echo. This is because the pre-echo may appear in the short windows.

In order to remove the pre-echo which may appear in the window, the TNS method may be used. The TNS method is based on the time-axis/frequency-axis duality of the LPC analysis.

In general, when the LPC analysis is applied to the time axis, the LPC means envelope information in the frequency axis and the excitation signal means a frequency component sampled in the frequency axis. When the LPC analysis is applied to the frequency axis, the LPC means envelope information in the time axis and the excitation signal means a time component sampled in the time axis, due to the time-frequency duality.

Accordingly, the noise appearing in the excitation signal due to an quantization error is finally reconstructed in proportion to the envelope information in the time axis. For example, in a sound less section in which the envelope information is close to 0, noise is finally generated close to 0. In a sounded section in which a voice and audio signal is present, noise is generated relatively greatly but the relatively-great noise can be hidden by the signal.

As a result, since noise disappears in the soundless section and the noise is hidden in the sounded section (voice and audio section), it is possible to provide sound quality which is psychoacoustically improved In dual communications, the total delay including a channel delay and a codec delay should not be greater than a predetermined threshold, for example, 200 ms. However, in the block switching method, since a frame is variable and the total delay is greater than 200 ms in the bidirectional communications, the block switching method is not suitable for dual communication.

Accordingly, a method of reducing a pre-echo using envelope information in the time domain on the basis of the concept of TNS is used for dual communication.

For example, a method of reducing a pre-echo by adjusting the level of a transform-decoded signal may be considered. In this case, the level of the transform-decoded signal in a frame in which noise based on a pre-echo appears is adjusted to be relatively small and the level of the transform-decoded signal in a frame in which noise based on a pre-echo does not appear is adjusted to be relatively large.

As described above, the artifacts known as a pre-echo in the transform encoding appear in a section in which signal energy rapidly increases. Accordingly, by reducing front signals in a part in which energy rapidly increases in a synthesis window, it is possible to reduce noise based on a pre-echo.

An echo zone is determined to reduce noise based on a pre-echo. For this purpose, two signals that overlap with each other at the time of inverse transform are used.

$\hat{S}_{32_SWB}(n)$ of 20 ms (=640 samples) which is a half of a window stored in a previous frame may be used as a first signal of the overlap signals. M(n) which is a first half of a current window may be used as a second signal of the overlap signals.

Two signals are concatenated as expressed by Expression 1 to generate an arbitrary signal $d^{conc}_{32_SWB}(n)$ of 1280 samples (=40 ms).

$$d_{=_SWB}^{conc}(n)=\hat{S}_{32_SWB}(n)$$

$$d_{32_SWB}^{conc}(n+640)=m(n) \qquad \text{<Expression 1>}$$

Since 640 samples are present in each signal section, n=0, . . . , 639.

The generated $d^{conc}_{32_SWB}(n)$ is divided into 32 subframes having 40 samples and a time-axis envelope E(i) is calculated using energy for each subframe. A subframe having the maximum energy may be found from E(i).

A normalization process is carried out as expressed by Expression 2 using the maximum energy value and the time-axis envelope.

$$r_E(i) = \frac{\mathrm{Max}_E}{E(i)},\ i = 0, \ldots, \mathrm{Max}idx_E - 1 \qquad \text{⟨Expression 2⟩}$$

Here, i represents an index of a subframe and $\mathrm{Maxind}_E$ represents an index of a subframe having the maximum energy.

When the value of $r_E(i)$ is equal to or greater than a predetermined reference value, for example, when $r_E(i)>8$, the corresponding section is determined to be an echo zone and a decay function $g_{pre}(n)$ is applied to the echo zone. When the decay function is applied to a time-domain signal, $g_{pre}(n)$ is set to 0.2 when $r_E(i)>16$, and $g_{pre}(n)$ is set to 1 when $r_E(i)<8$, and $g_{pre}(n)$ is set to 0.5 otherwise, whereby a final synthesized signal is generated. At this time, a first infinite impulse response (IIR) filter may be used to smooth the decay function of a previous frame and the decay function of a current frame.

In order to reduce a pre-echo, the unit of multi-frames instead of a fixed frame may be used depending on signal characteristics to perform encoding. For example, a frame of 20 ms, a frame of 40 ms, and a frame of 80 ms may be used depending on the signal characteristics.

On the other hand, a method of applying various frame sizes may be considered to solve the problem with a pre-echo in the transform encoding while selectively applying the CELP encoding and the transform encoding depending on the signal characteristics.

For example, a frame having a small size of 20 ms may be used as a basic frame and a frame having a large size of 40 ms or 80 ms may be used for a stationary signal. When it is assumed that the internal sampling rate is 12.8 kHz, 20 ms is a size corresponding to 256 samples.

Figure 8:
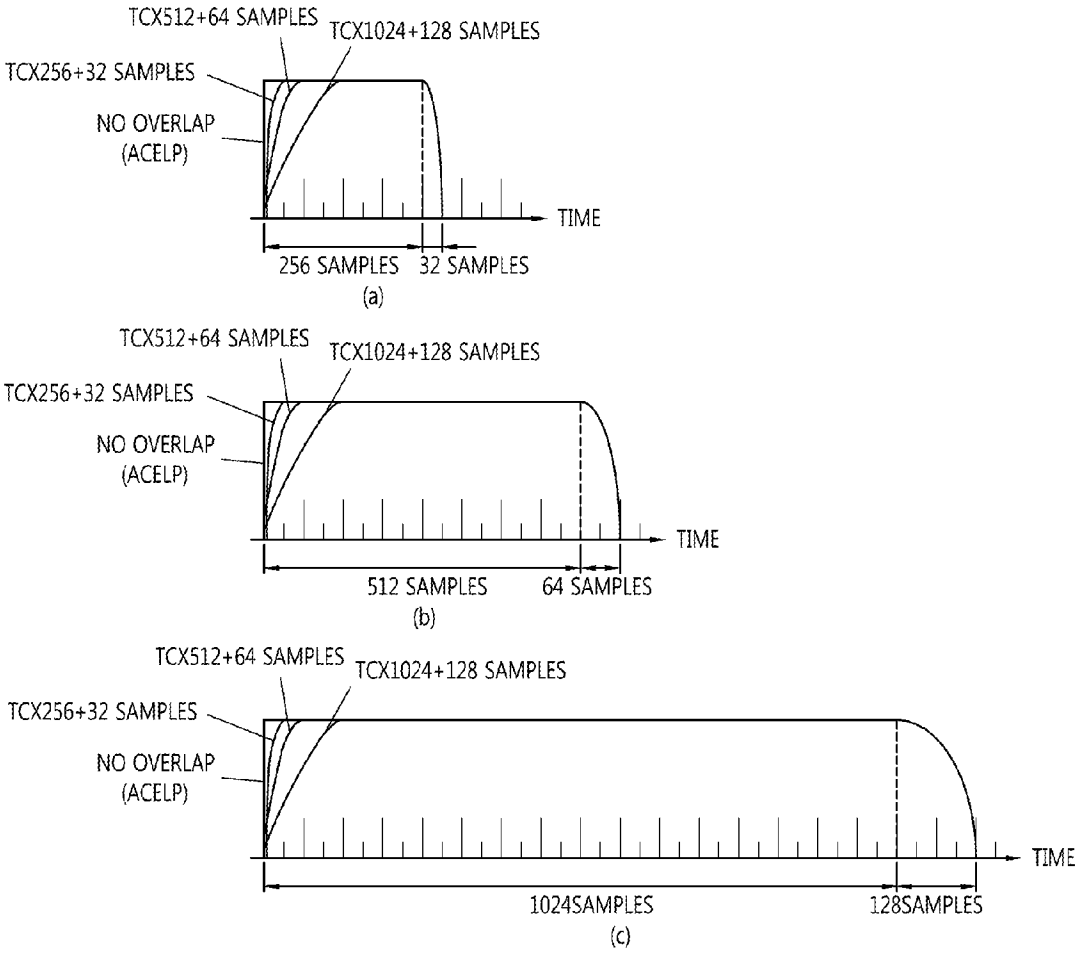
FIG. 8 is a diagram schematically illustrating an example of a window type when a basic frame is set to 20 ms and 40 ms and 80 ms which are frames having larger sizes are used depending on signal characteristics.

FIG. 8 is a diagram schematically illustrating an example of window types when a basic frame is set to 20 ms and frames having larger sizes of 40 ms and 80 ms are used depending on signal characteristics.

FIG. 8(*a*) illustrates a window for the basic frame of 20 ms, FIG. 8(*b*) illustrates a window for the frame of 40 ms, and FIG. 8(*c*) illustrates a window for the frame of 80 ms.

When a final signal is reconstructed using an overlap addition of TCX and CELP based on transform, three types of window lengths are used but four window shapes for each length may be used for the overlap addition to a previous frame. Accordingly, total 12 windows may be used depending on signal characteristics.

However, in the method of adjusting the signal level in an area in which a pre-echo may appear, the signal level is adjusted on the basis of a signal reconstructed from a bitstream. That is, an echo zone is determined and a signal is decreased using a signal reconstructed by the voice decoder with the bits allocated by the voice encoder.

At this time, a fixed number of bits for each frame is allocated in the voice encoder. This method is an approach for controlling a pre-echo with a concept similar to a post-processing filter. In other words, for example, when a current frame size is fixed to 20 ms, the bits allocated to the frame of 20 ms are dependent on the total bit rate and are transmitted as a fixed value. The procedure of controlling a pre-echo is carried out on the basis of the information transmitted from the voice encoder by the voice decoder.

In this case, the psychoacoustic hiding of the pre-echo is limited, and this limit is remarkable in an attack signal in which energy more rapidly varies.

In the approach in which the frame size is variably used on the basis of the block switching, since the window size to be processed is selected depending on the signal characteristics by the voice encoder, the pre-echo can be efficiently reduced but it is difficult to use this approach as a dual communication codec which should have a minimum fixed site. For example, when dual communication is assumed in which 20 ms should be transmitted as a packet and a frame having a large size of 80 ms is set, the bits corresponding to four times the basic packet are allocated and thus a delay based thereon is caused.

Therefore, in the present invention, in order to efficiently control noise based on a pre-echo, a method of variably allocating the bits to bit allocation sections in a frame is used as a method which can be performed by the voice encoder.

For example, the bit allocation may be carried out in consideration of an area in which a pre-echo may appear instead of applying a fixed bit rate to an existing frame or subframes of a frame. According to the present invention, more bits with an increased bit rate are allocated to an area in which a pre-echo appears.

Since more bits are allocated to the area in which a pre-echo appears, it is possible to more fully perform the encoding and to reduce the noise level based on the pre-echo.

For example, when M subframes are set for each frame and bits are allocated to the respective subframes, the same amount of bits are allocated at the same bit rate to M subframes in the related art. On the contrary, in the present invention, the bit rate for a subframe in which a pre-echo is present, that is, in which an echo zone is present, can be adjusted to be higher.

In this description, in order to distinguish a subframe as a signal processing unit from a subframe as a bit allocation unit, M subframes as the bit allocation units are referred to as bit allocation sections.

For the purpose of convenience of explanation, the number of bit allocation sections for each frame is assumed to be 2.

Figure 9:
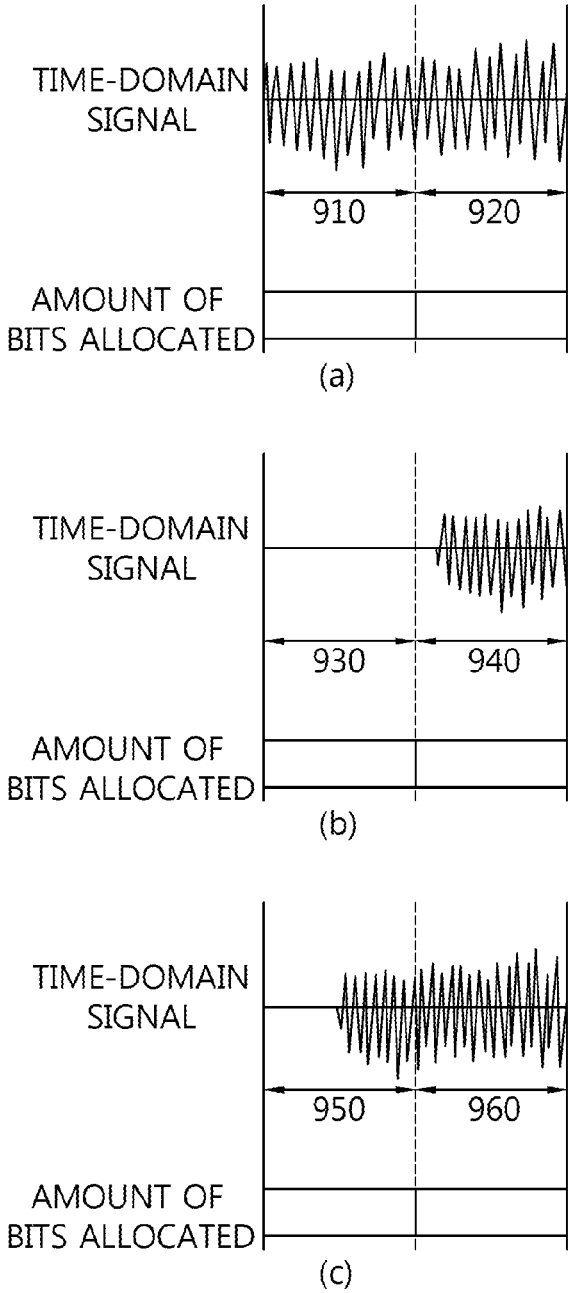
FIG. 9 is a diagram schematically illustrating a relationship between a position of a pre-echo and bit allocation.

FIG. 9 is a diagram schematically illustrating a relationship between a position of a pre-echo and bit allocation.

FIG. 9 illustrates an example where the same bit rate is applied to the bit allocation sections.

When two bit allocation sections are set, voice signals are uniformly distributed over the whole frame in FIG. 9(*a*), and bits corresponding to a half of the total bits are allocated to a first bit allocation section 910 and a second bit allocation section 920, respectively.

In FIG. 9(*b*), a pre-echo is present in a second bit allocation section 940. In FIG. 9(*b*), since a first bit allocation section 930 is a section close to a soundless section, less bits can be allocated thereto but bits corresponding to a half of the total bits are used therein in the related art.

In FIG. 9(*c*), a pre-echo is present in a first bit allocation section 950. In FIG. 9(*c*), since a second bit allocation section 960 corresponds to a stationary signal, the second bit allocation section can be encoded using less bits but bits corresponding to a half of the total bits are used therein.

In this way, when bits are allocated regardless of the position of a section in which an echo zone is present or energy rapidly increases, the bit efficiency is lowered.

In the present invention, when fixed total bits for each frame are allocated to bit allocation sections, the bits to be allocated to the bit allocation bits vary depending on whether an echo zone is present.

In the present invention, in order to variably allocate bits depending on characteristics (for example, the position of an echo zone) of a voice signal, energy information of a voice signal and position information of a transient component in which noise based on a pre-echo may appear are used. A transient component in a voice signal means a component in an area in which a transient having a rapid energy variation is present, for example, a voice signal component at a position at which voiceless sound is transitioned to voiced sound or a voice signal component at a position at which voiced sound is transitioned to voiceless sound.

Figure 10:
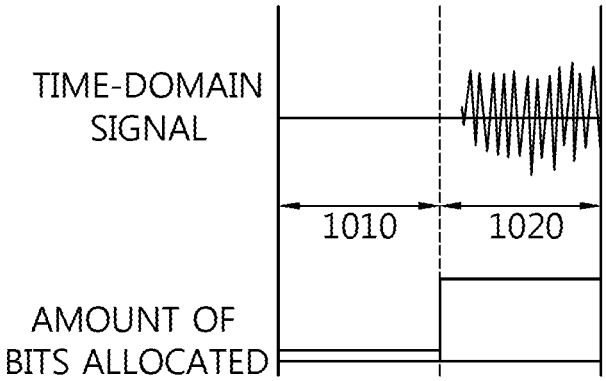
FIG. 10 is a diagram schematically illustrating a bit allocating method according to the present invention.
Figure 10:
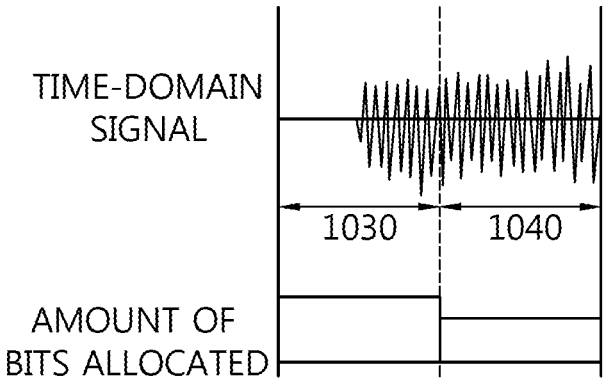

FIG. 10 is a diagram schematically illustrating a method of allocating bits according to the present invention.

As described above, the bit allocation may be variably carried out on the basis of the energy information of a voice signal and the position information of a transient component in the present invention.

Referring to FIG. 10(*a*), since a voice signal is located in a second bit allocation section 1020, the energy of a voice signal in a first bit allocation section 1010 is smaller than the energy of a voice signal in the second bit allocation section 1020.

When a bit allocation section (for example, a soundless section or a section including voiceless sound) in which the energy of a voice signal is small is present, a transient component may be present. In this case, the bits to be allocated to a bit allocation section in which a transient component is not present may be reduced and the saved bits may be additionally allocated to a bit allocation section in which the transient component is present. For example, in FIG. 10(*a*), the bits to be allocated to the first bit allocation section 101 which is the voiceless sound section are minimized and the saved bits may be additionally allocated to the second bit allocation section 1020, that is, the bit allocation section in which the transient component of a voice signal is present.

Referring to FIG. 10(*b*), a transient component is present in a first bit allocation section 1030 and a stationary signal is present in a second bit allocation section 1040.

In this case, the energy in the second bit allocation section 1040 in which the stationary signal is present is larger than the energy in the first bit allocation section 1030. When the energy is uneven in the bit allocation sections, a transient component may be present and more bits may be allocated to the bit allocation section in which the transient component is present. For example, in FIG. 10(*b*), the bits to be allocated to the second bit allocation section 1040 which is a stationary signal section may be reduced and the saved bits may be allocated to the first bit allocation section 1030 in which the transient component of a voice signal is present.

Figure 11:
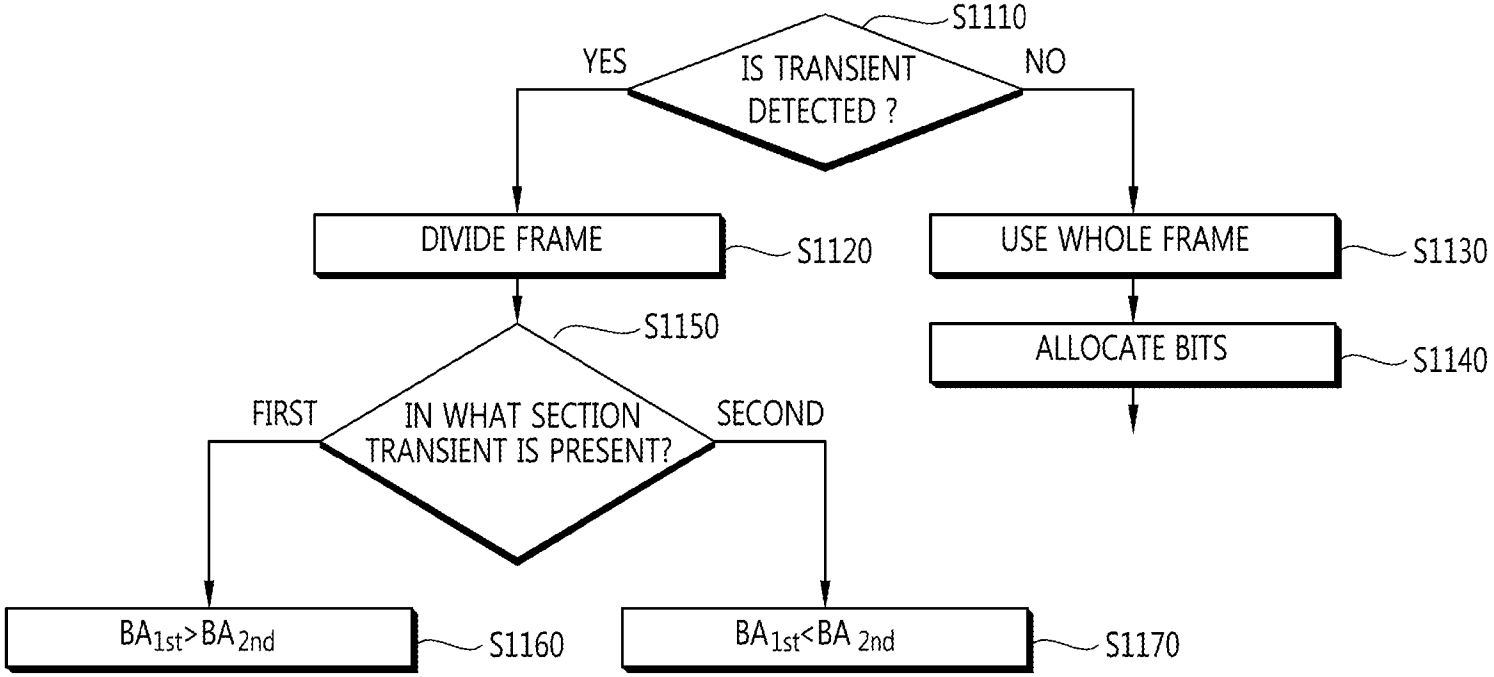
FIG. 11 is a flowchart schematically illustrating a method of variably allocating bits in the encoder according to the present invention.

FIG. 11 is a flowchart schematically illustrating a method of variably allocating bits in a voice encoder according to the present invention.

Referring to FIG. 11, the voice encoder determines whether a transient is detected in a current frame (S1110). When the current frame is divided into M bit allocation sections, the voice encoder may determine whether energy is even in the sections and may determine that a transient is present when the energy is not even. The voice encoder may set, for example, a threshold offset and may determine that a transient is present in the current frame when an energy difference between the sections is greater than the threshold offset.

For the purpose of convenience of explanation, when M is assumed to be 2 and the energy of a first bit allocation section and the energy of a second bit allocation section are not equal to each other (when a difference equal to or greater than a predetermined reference value is present between the energy values), it may be determined that a transient is present in the current frame.

The voice encoder may select an encoding method depending on whether a transient is present. When a transient is present, the voice encoder may divide the current frame into bit allocation sections (S1120).

When a transient is not present, the voice encoder may not divide the current frame into the bit allocation sections but may use the whole frame (S1130).

When the whole frame is used, the voice encoder allocates bits to the whole frame (S1140). The voice encoder may encode a voice signal in the whole frame using the allocated bits.

For the purpose of convenience of explanation, it is described that the step of determining that the whole frame is used is performed and then the step of allocating bits is performed when a transient is not present, but the present invention is not limited to this configuration. For example, when a transient is present, the bit allocation may performed on the whole frame without performing the step of determining that the whole frame is used.

When it is determined that a transient is present and the current frame is divided into bit allocation sections, the voice encoder may determine in which bit allocation section the transient is present (S1150). The voice encoder may differently allocate bits to the bit allocation section in which the transient is present and the bit allocation section in which the transient is not present.

For example, when the current frame is divided into two bit allocation sections and the transient is present in the first bit allocation section, more bits may be allocated to the first bit allocation section than the second bit allocation section (S1160). For example, when the amount of bits allocated to the first bit allocation section is $BA_{1st}$ and the amount of bits allocated to the second bit allocation section is $BA_{2nd}$, $BA_{1st}>BA_{2nd}$ is established.

For example, when the current frame is divided into two bit allocation sections and the transient is present in the second bit allocation section, more bits may be allocated to the second bit allocation section than the first bit allocation section (S1170). For example, when the amount of bits allocated to the first bit allocation section is $BA_{1st}$ and the amount of bits allocated to the second bit allocation section is $BA_{2nd}$, $BA_{1st}<BA_{2nd}$ is established.

When the current frame is divided into two bit allocation sections, the total number of bits (amount of bits) allocated to the current frame is $Bit_{budget}$, the number of bits (amount of bits) allocated to the first bit allocation section is $BA_{1st}$, and the number of bits (amount of bits) allocated to the second bit allocation section is $BA_{2nd}$, the relationship of Expression 3 is established.

$$Bit_{budget}=BA_{1st}+BA_{2nd} \quad \text{<Expression 3>}$$

At this time, by considering in what of the two bit allocation sections the transient is present and what the energy levels of voice signals in the two bit allocation sections are, the number of bits to allocated to the respective bit allocation sections may be determined as expressed by Expression 4.

$$\frac{Transient_{1st} \times Energy_{1st}}{Transient_{1st} \times Energy_{1st} + Transient_{2nd} \times Energy_{2nd}} Bit_{budget}^{subframe} = BA_{1st} \quad \text{⟨Expression 4⟩}$$

$$\frac{Transient_{2nd} \times Energy_{2nd}}{Transient_{1st} \times Energy_{1st} + Transient_{2nd} \times Energy_{2nd}} Bit_{budget}^{subframe} = BA_{2nd}$$

In Expression 4, $Energy_{n\text{-}th}$ represents the energy of a voice signal in the n-th bit allocation section and $Transient_{n\text{-}th}$ represents a weight constant in the n-th bit allocation section and has different values depending on whether a transient is present in the corresponding bit allocation section. Expression 5 expresses an example of a method of determining the value of $Transient_{n\text{-}th}$.

If a transient is present in the first bit allocation section $$Transient_{1st}=1.0 \ \& \ Transient_{2nd}=0.5$$

Otherwise (that is, if a transient is present in the second bit allocation section)

$$Transient_{1st}=1.5 \ \& \ Transient_{2nd}=1.0 \quad \text{<Expression 5>}$$

Expression 5 expresses an example where the weight constant Transient based on the position of a transient is set to 1 or 0.5, but the present invention is not limited to this example. The weight constant Transient may be set to different values by experiments or the like.

On the other hand, as described above, the method of variably allocating the number of bits depending on the position of a transient, that is, the position of an echo zone may be applied to the dual communications.

When it is assumed that the size of a frame used for dual communication is A ms and the transmission bit rate of the voice encoder is B kbps, the size of the analysis and synthesis window used for the transform voice encoder is 2 A ms and the transmission bit rate for a frame in the voice encoder is BxA bits. For example, when the size of a frame is 20 ms, the synthesis window is 40 ms and the transmission rate for a frame is B/50 kbits.

When the voice encoder according to the present invention is used for dual communication, a narrowband (NB)/wideband (WB) core is applied to a lower band and a form of a so-called extended structure in which encoded information is used for an upper codec for a super wideband may be applied.

Figure 12:
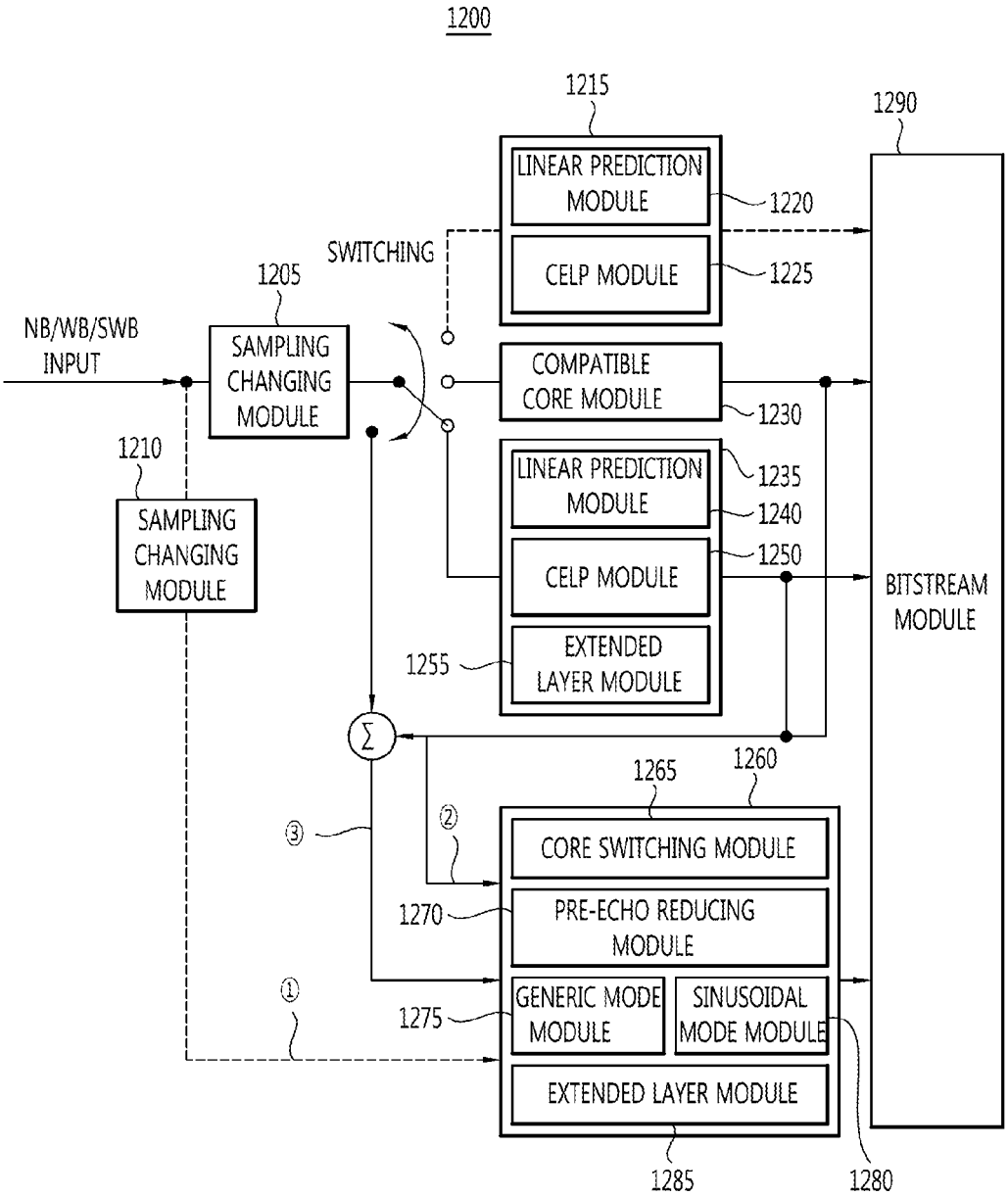
FIG. 12 is a diagram schematically illustrating a configuration example of voice encoder having a form of an extended structure according to the present invention.

FIG. 12 is a diagram schematically illustrating an example of a configuration of a voice encoder having the form of an extended structure to which the present invention is applied.

Referring to FIG. 12, the voice encoder having an extended structure includes a narrowband encoding module 1215, a wideband encoding module 1235, and a super wideband encoding module 1260.

A narrowband signal, a wideband signal, or a super-wideband signal is input to a sampling changing module 1205. The sampling changing module 1205 changes the input signal to an internal sampling rate 12.8 kHz and outputs the changed input signal. The output of the sampling changing module 1205 is transmitted to the encoding module corresponding to the band of the output signal by a switching module.

When the narrow-band signal or the wideband signal is input, a sampling changing module 1210 up-samples the input signal to a super-wideband signal, then generates a signal of 25.6 kHz, and outputs the up-sampled super-wideband signal and the generated signal of 25.6 kHz. When the super-wideband signal is input, the input signal is down-sampled to 25.6 kHz and then is output along with the super-wideband signal.

A lower-band encoding module 1215 encodes the narrowband signal and includes a linear prediction module 1220 and an ACELP module 1225. After the linear prediction module 1220 performs linear prediction, the residual signal is encoded on the basis of the CELP by a CELP module 1225.

The linear prediction module 1220 and the CELP module 1225 of the lower-band encoding module 1215 correspond to the configuration for encoding a lower band on the basis of the linear prediction and the configuration for encoding a lower band on the basis of the CELP in FIGS. 1 and 3, respectively.

A compatible core module 1230 corresponds to the core configuration in FIG. 1. The signal reconstructed by the compatible core module 1230 may be used for the encoding in the encoding module that processes a super-wideband signal. Referring to the drawing, the compatible core module 1230 may process the lower-band signal by compatible encoding such as AMR-WB and may cause a super-wideband encoding module 1260 to process an upper-band signal.

A wideband encoding module 1235 encodes a wideband signal and includes a linear prediction module 1240, a CELP module 1250, and an extended layer module 1255. The linear prediction module 1240 and the CELP module 1250 corresponds to the configuration for encoding a wideband signal on the basis of the linear prediction and the configuration for encoding a lower-band signal on the basis of the CELP, respectively, in FIGS. 1 and 3. When the bit rate increases by processing an additional layer, the extended layer module 1255 may encode the input signal to higher sound quality.

The output of the wideband encoding module 1235 may be inversely reconstructed and may be used for encoding in the super-wideband encoding module 1260.

The super-wideband encoding module 1260 encodes a super-wideband signal, transforms the input signals, and processes the transform coefficients.

The super-wideband signal is encoded by a generic mode module 1275 and a sinusoidal mode module 1280 as illustrated in the drawing, and a module for processing a signal may be switched between the generic mode module 1275 and the sinusoidal mode module 1280 by a core switching module 1265.

A pre-echo reducing module 1270 reduces a pre-echo using the above-mentioned method according to the present invention. For example, the pre-echo reducing module 1270 determines an echo zone using an input time-domain signal and input transform coefficients, and may variably allocate bits on the basis thereof.

An extended layer module 1285 processes a signal of an additional extended layer (for example, layer 7 or layer 8) in addition to a base layer.

In the present invention, it is described that the pre-echo reducing module 1270 operates after the core switching between the generic mode module 1275 and the sinusoidal mode module 1280 is performed in the super-wideband encoding module 1260, but the present invention is not limited to this configuration. After the pre-echo reducing module 1270 performs the pre-echo reducing operation, the core switching between the generic mode module 1275 and the sinusoidal mode module 1280 may be performed.

The pre-echo reducing module 1270 illustrated in FIG. 12 may determine in what bit allocation section a transient is present in the voice signal frame on the basis of energy unevenness in the bit allocation sections and then may allocate different numbers of bits to the bit allocation sections, as described with reference to FIG. 11.

The pre-echo reducing module may employ the method of determining the position of an echo zone in the unit of subframes on the basis of the energy level of the subframes in a frame and reducing a pre-echo.

Figure 13:
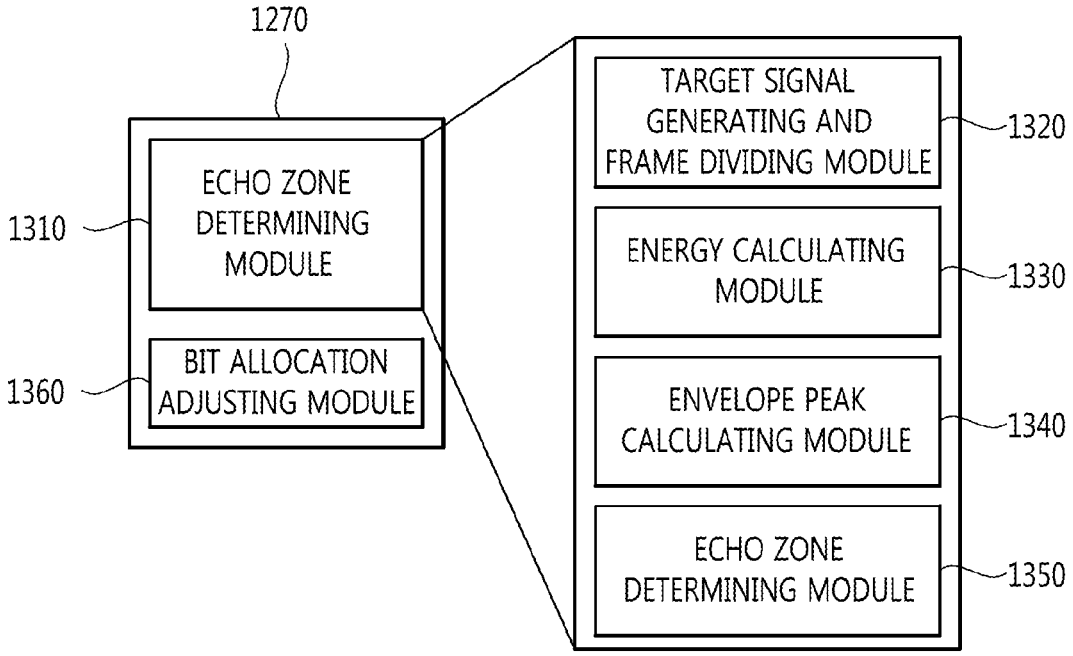
FIG. 13 is a diagram schematically illustrating a configuration of a pre-echo reducing module.

FIG. 13 is a diagram schematically illustrating a configuration when the pre-echo reducing module illustrated in FIG. 12 determines an echo zone on the basis of subframe energy and reduces a pre-echo. Referring to FIG. 13, the pre-echo reducing module 1270 includes an echo zone determining module 1310 and a bit allocation adjusting module 1360.

The echo zone determining module 1310 includes a target signal generating and frame dividing module 1320, an energy calculating module 1330, an envelope peak calculating module 1340, and an echo zone determining module 1350.

When the size of a frame to be processed by the super-wideband encoding module is 2 L ms and M bit allocation sections are set, the size of each bit allocation section is 2 L/M ms. When the transmission bit rate of a frame is B kbps, the amount of bits allocated to the frame is B×2 L bits. For example, when L=10 is set, the total amount of bits allocated to the frame is B/50 kbits.

In the transform coding, the current frame is concatenated to a previous frame, and the resultant is windowed using an analysis window and is then transformed. For example, it is assumed that the size of a frame is 20 ms, that is, a signal to be processes is input in the unit of 20 ms. Then, when the total frame is processed as a time, the current frame of 20 ms and the previous frame of 20 ms are concatenated to construct a single signal unit for MDCT and the signal unit is windowed using an analysis window and is then transformed. That is, an analysis target signal is constructed using the previous frame for transforming the current frame and is transformed. When it is assumed that two (M) bit allocation sections are set, a part of the previous frame and the current frame overlap and are transformed two (M) times so as to transform the current frame. That is, the second half 10 ms of the previous frame and the first half 10 ms of the current frame are windowed using an analysis window (for example, a symmetric window such as a sinusoidal window and a Hamming window) and the first half 10 ms of the current frame and the second half 10 ms of the current frame are windowed using the analysis window.

In the voice encoder, the current frame and a subsequent frame may be concatenated and may be transformed after windowing with the analysis window.

On the other hand, the target signal generating and frame dividing module 1320 generates a target signal on the basis of an input voice signal and divides a frame into subframes.

The signal input to the super-wideband encoding module includes ① a super-wideband signal of an original signal, ② a signal decoded again through narrowband encoding or wideband encoding, and ③ a difference signal between the wideband signal of the original signal and the decoded signal.

The input signals (①, ②, and ③) in the time domain may be input in the unit of frames (for example, in the unit of 20 ms) and are transformed to generate transform coefficients. The generated transform coefficients are processed by signal processing modules such as the pre-echo reducing module in the super-wideband encoding module.

At this time, the target signal generating and frame dividing module 1320 generates a target signal for determining whether an echo zone is present on the basis of the signals of ① and ② having the super-wideband components.

The target signal $d^{conc}_{32_SWB}(n)$ can be determined as expressed by Expression 6.

$$d_{32_SWB}^{conc}(n) = \text{signal of ① – scaled signal of ①} \quad \text{<Expression 6>}$$

In Expression 6, n represents a sampling position. The scaling of the signal of ① is up-sampling of changing the sampling rate of the signal of ① to a sampling rate of a super-wideband signal.

The target signal generating and frame dividing module 1320 divides a voice signal frame into a predetermined number of (for example, N, where N is an integer) subframes so as to determine an echo zone. A subframe may be a process unit of sampling and/or voice signal processing. For example, a subframe may be a process unit for calculating an envelope of a voice signal. When the computational load is not considered, the more subframes the frame is divided into, the more accurate value can be obtained. When one sample is processed for each subframe and a frame length of a super-wideband signal is 20 ms, N is equal to 640.

Further, the subframe may also be used as an energy calculation unit for determining an echo zone. For example, the target signal $d^{conc}_{32_SWB}(n)$ in Expression 6 may be used to calculate voice signal energy in the unit of subframes.

The energy calculating module 1330 calculates voice signal energy of each subframe using the target signal. For the purpose of convenience of explanation, the number of subframes N per frame is set to 16.

The energy of each subframe may be calculated by Expression 7 using the target signal $d^{conc}_{32_SWB}(n)$.

$$E(i) = \sum_{n=40i}^{40(i+1)-1} [d_{32_SWB}^{conc}(n)]^2,\ i = 0, \ldots, 15 \quad \text{⟨Expression 7⟩}$$

In Expression 7, i represents an index indicating a subframe, and n represents a sample number (sample position). E(i) corresponds to an envelope in the time domain (time axis).

The envelope peak calculating module 1340 determines the peak $Max_E$ of an envelope in the time domain (time axis) by Expression 8 using E(i).

$$Max_E = \max_{i=0,\ldots,15} E(i) \quad \text{⟨Expression 8⟩}$$

In other words, the envelope peak calculating module 1340 finds out a subframe in which the energy is largest out of N subframes in a frame.

The echo zone determining module 1350 normalizes the energy values of the N subframes in a frame, compares the normalized energy values with a reference value, and determines an echo zone.

The energy values of the subframes may be normalized by Expression 9 using the envelop peak value determined by the envelope peak calculating module 1340, that is, the largest energy value out of the energy values of the subframes.

$$\text{Normal_E}(i) = \frac{E(i)}{Max_E} \quad \text{⟨Expression 9⟩}$$

Here, Normal_E(i) represents the normalized energy of the i-th subframe.

The echo zone determining module 1350 determines an echo zone by comparing the normalized energy values of the subframes with a predetermined reference value (threshold value).

For example, the echo zone determining module 1350 compares the normalized energy values of the subframes with the predetermined reference value sequentially from the first subframe to the final subframe in a frame. When the normalized energy value of the first subframe is smaller than the reference value, the echo zone determining module 1350 may determine that an echo zone is present in the subframe first found to have the normalized energy value equal to or greater than the reference value. When the normalized energy value of the first subframe is greater than the reference value, the echo zone determining module 1350 may determine that an echo zone is present in the subframe first found to have the normalized energy value equal to or less than the reference value.

The echo zone determining module 1350 may compare the normalized energy values of the subframes with a predetermined reference value in the reverse order in the above-mentioned method from the final subframe to the first subframe in a frame. When the normalized energy value of the final subframe is less than the reference value, the echo zone determining module 1350 may determine that an echo zone is present in the subframe first found to have the normalized energy value equal to or greater than the reference value. When the normalized energy value of the final subframe is greater than the reference value, the echo zone determining module 1350 may determine that an echo zone is present in the subframe first found to have the normalized energy value equal to or less than the reference value.

Here, the reference value, that is, the threshold value, may be experimentally determined. For example, when the threshold value is 0.128 and the comparison is performed from the first subframe, and the normalized energy value of the first subframe is less than 0.128, it may be determined that an echo zone is present in the subframe first found to have the normalized energy value greater than 0.128 while sequentially searching the normalized energy values.

When a subframe satisfying the above-mentioned condition is not found, that is, when a subframe in which the normalized energy value is changed from equal to or less than the reference value to equal to or greater than the reference value, or a subframe in which the normalized energy value is changed from equal to or greater than the reference value to equal to or less than the reference value is not found, the echo zone determining module 1350 may determine that an echo zone is not present in the current frame.

When the echo zone determining module 1350 determines that an echo zone is present, a bit allocation adjusting module 1360 may differently allocate amounts of bits to the area in which the echo zone is present and the other area.

When the echo zone determining module 1350 determines that an echo zone is not present, the additional bit allocation adjustment of the bit allocation adjusting module 1360 may be bypassed or the bit allocation adjustment may be performed so that bits are uniformly allocated to the current frame as described with reference to FIG. 11.

For example, when it is determined that an echo zone is present, the normalized time-domain envelope information, that is, Normal_E(i), may be transmitted to the bit allocation adjusting module 1360.

The bit allocation adjusting module 1360 allocates bits to the bit allocation sections on the basis of the normalized time-domain envelope information. For example, the bit allocation adjusting module 1360 differently allocate the total bits allocated to the current frame to the bit allocation section in which the echo zone is present and the bit allocation section in which the echo zone is not present.

The number of bit allocation sections may be set to M depending on the total bit rate for the current frame. When the total amount of bits (bit rate) is sufficient, the bit allocation sections and the subframes may be set to be the same (M=N). However, since M pieces of bit allocation information should be transmitted to the voice decoder, the excessively great M may not be preferable for the encoding efficiency in consideration of the amount of information computed and the amount of information transmitted. An example where M is equal to 2 is described above with reference to FIG. 11.

For the purpose of convenience of explanation, an example where M=2 and N=32 are set will be described below. It is assumed that the normalized energy value of the 20-th subframe out of 32 subframes is 1. Then, an echo zone is present in the second bit allocation section. When the total bit rate allocated to the current frame is C kbps, the bit allocation adjusting module 1360 may allocate bits of C/3 kbps to the first bit allocation section and may allocate bits of 2C/3 kbps to the second bit allocation section.

Accordingly, the total bit rate allocated to the current frame is fixed as C kbps, but more bits may be allocated to the second bit allocation section in which an echo zone is present.

It is described that twice bits are allocated to the bit allocation section in which an echo zone is present, but the present invention is not limited to this example. For example, as expressed by Expressions 4 and 5, the amount of bits to be allocated may be adjusted in consideration of the weight values depending on presence of an echo zone and the energy values of the bit allocation sections.

On the other hand, when the amounts of bits allocated to the bit allocation sections in the frame are changed, information on the bit allocation needs to be transmitted to the voice decoder. For the purpose of convenience of explanation, when it is assumed that the amounts of bits allocated to the bit allocation sections are bit allocation modes, the voice encoder/voice decoder may construct a bit allocation information table in which the bit allocation modes are defined and may transmit/receive bit allocation information using the table.

The voice encoder may transmit an index in the bit allocation information table indicating what bit allocation mode should be used to the voice decoder. The voice decoder may decode the encoded voice information depending on the bit allocation mode in the bit allocation information table indicated by the index received from the voice encoder.

Table 1 shows an example of the bit allocation information table used to transmit the bit allocation information.

TABLE 1

| Value of bit allocation mode index | First bit allocation section | Second bit allocation section |
|---|---|---|
| 0 | C/2 | C/2 |
| 1 | C/3 | 2C/3 |
| 2 | C/4 | 3C/4 |
| 3 | C/5 | 4C/5 |

Table 1 shows an example where the number of bit allocation sections is 2 and the fixed number of bits allocated to the frame is C. When Table 1 is used as the bit allocation information table and 0 as the bit allocation mode is transmitted by the voice encoder, it is indicated that the same amount of bits are allocated to two bit allocation sections. When the value of the bit allocation mode index is 0, it means that an echo zone is not present.

When the value of the bit allocation mode index is in a range of 1 to 3, different amounts of bits are allocated to the two bit allocation sections. In this case, it means that an echo zone is present in the current frame.

Table 1 shows only a case where an echo zone is not present or a case where an echo zone is present in the second bit allocation section, but the present invention is not limited to these cases. For example, as shown in Table 2, the bit allocation information table may be constructed in consideration of both a case where an echo zone is present in the first bit allocation section and a case where an echo zone is present in the second bit allocation section.

TABLE 2

| Value of bit allocation mode index | First bit allocation section | Second bit allocation section |
|---|---|---|
| 0 | C/3 | 2C/3 |
| 1 | 2C/3 | C/3 |
| 2 | C/4 | 3C/4 |
| 3 | 3C/4 | C/4 |

Table 2 also shows an example where the number of bit allocation sections is 2 and the fixed number of bits allocated to the frame is C. Referring to Table 2, indices 0 and 2 indicate the bit allocation modes in the case where an echo zone is present in the second bit allocation section, and indices 1 and 3 indicate the bit allocation modes in the case where an echo zone is present in the first bit allocation section.

When table 2 is used as the bit allocation information table and an echo zone is not present in the current frame, the values of the bit allocation mode indices may not be transmitted. When no bit allocation mode index is transmitted, the voice decoder may determine that the whole current frame is used as a single bit allocation unit and the fixed number of bits C is allocated thereto and then may perform decoding.

When a value of a bit allocation mode index is transmitted, the voice decoder may perform decoding on the current frame on the basis of the bit allocation mode in the bit allocation information table of Table 2 indicated by the transmitted index value.

Tables 1 and 2 show an example where the bit allocation information index is transmitted using two bits. When the bit allocation information index is transmitted using two bits, information on four modes may be transmitted as shown in Tables 1 and 2.

It is described above that the information of the bit allocation mode is transmitted using two bits, but the present invention is not limited to this example. For example, the bit allocation may be performed using bit allocation modes greater than four and the information on the bit allocation mode may be transmitted using transmission bits greater than two bits. The bit allocation may be performed using bit allocation modes less than four and the information on the bit allocation mode may be transmitted using transmission bits (for example, one bit) less than two bits.

Even when the bit allocation information is transmitted using the bit allocation information table, the voice encoder may determine the position of an echo zone as described above, may select a mode in which more bits are allocated to a bit allocation section in which the echo zone is present, and may transmit an index indicating the selected mode.

Figure 14:
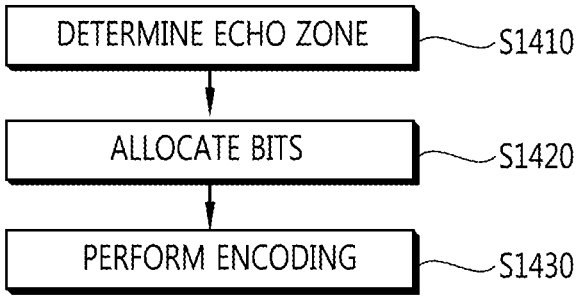
FIG. 14 is a flowchart schematically illustrating a method of variably allocating bits to encode a voice signal in the encoder according to the present invention.

FIG. 14 is a flowchart schematically illustrating a method of causing a voice encoder to variably perform the bit allocation and to encode a voice signal according to the present invention.

Referring to FIG. 14, the voice encoder determines an echo zone in a current frame (S1410). When the transform encoding is performed, the voice encoder divides the current frame into M bit allocation sections and determines whether an echo zone is present in the respective bit allocation sections.

The voice encoder may determine whether the voice signal energy values of the bit allocation sections are even within a predetermined range and may determine that an echo zone is present in the current frame when an energy difference departing from the predetermined range is present between the bit allocation sections. In this case, the voice encoder may determine that an echo zone is present in the bit allocation section in which a transient component is present.

the voice encoder may divide the current frame into N subframes, may calculate normalized energy values of the subframes, and may determine that an echo zone is present in the corresponding subframe when the normalized energy value varies with respect to a threshold value.

When the voice signal energy values are uniform within the predetermined range or a normalized energy value varying with respect to the threshold value is not present, the voice encoder may determine that an echo zone is not present in the current frame.

The voice encoder may allocate encoding bits to the current frame in consideration of presence of an echo zone (S1420). The voice encoder allocates the total number of bits allocated to the current frame to the bit allocation sections. The voice encoder can prevent or reduce noise based on a pre-echo by allocating more bits to the bit allocation section in which an echo zone is present. At this time, the total number of bits allocated to the current frame may be a fixed value.

When it is determined in step S1410 that an echo zone is not present, the voice encoder may not differently allocate the bits to the bit allocation sections divided from the current frame, but may use the total number of bits in the unit of a frame.

The voice encoder performs encoding using the allocated bits (S1430). When an echo zone is present, the voice encoder may perform the transform encoding while preventing or reducing noise based on a pre-echo using the differently-allocated bits.

The voice encoder may transmit information on the used bit allocation mode along with the encoded voice information to the voice decoder.

Figure 15:
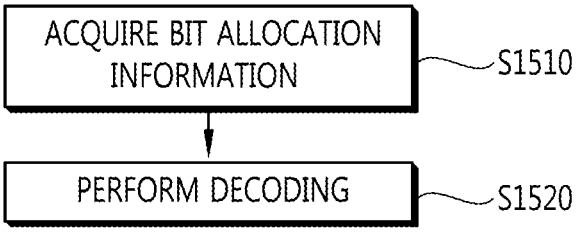
FIG. 15 is a diagram schematically illustrating a method of decoding an encoded voice signal when bits are variably allocated in encoding a voice signal according to the present invention.

FIG. 15 is a diagram schematically illustrating a method of decoding an encoded voice signal when bit allocation is variably performed for encoding a voice signal according to the present invention.

The voice decoder receives the bit allocation information along with the encoded voice information from the voice encoder (S1510). The encoded voice information and the information on the bits allocated to encode the voice information may be transmitted through the use of a bitstream.

The bit allocation information may indicate whether bits are differently allocated to sections in the current frame. The bit allocation information may also indicate at what ratio the bits are allocated when the bits have differently been allocated.

The bit allocation information may be index information, and the received index may indicate the bit allocation mode (the bit allocation ratio or the amounts of bits allocated to the bit allocation sections) in the bit allocation information table applied to the current frame.

The voice decoder may perform decoding on the current frame on the basis of the bit allocation information (S1520). When bits are differently allocated in the current frame, the voice decoder may decode voice information using the bit allocation mode.

In the above-mentioned embodiments, parameter values or set values are exemplified above for the purpose of easy understanding of the present invention, but the present invention is not limited to the embodiments. For example, it is described above that the number of subframes N is 24 for 32, but the present invention is not limited to this example. It is described above that the number of bit allocation sections M is 2 for the purpose of convenience of explanation, but the present invention is not limited to this example. The threshold value for comparison with the normalized energy level for determining an echo zone may be determined as an arbitrary value set by a user or an experimental value. It is described above that the transform operation is performed for each of two bit allocation sections in a fixed frame of 20 ms, but this example is intended for convenience of explanation and the present invention is not limited by the frame size, the number of transform operations depending on the bit allocation sections, and the like and does not limit the technical features of the present invention. Accordingly, the parameter values or the set values in the present invention may be changed to various values.

While the methods in the above-mentioned exemplary embodiments have been described on the basis of flowcharts including a series of steps or blocks, the invention is not limited to the order of steps but a certain step may be performed in a step or an order other than described above or at the same time as described above. The above-mentioned embodiments can include various examples. For example, the above-mentioned embodiments may be combined, and these combinations are also included in the invention. The invention includes various changes and modifications based on the technical spirit of the present invention belonging to the appended claims.

The invention claimed is:

1. A voice signal encoding method, the method comprising:

determining whether or not an echo zone is present in a current frame, the echo zone being an area having small energy in a section in which a transient of an energy level is present;

if the echo zone is not present in the current frame:

allocating C bits to the current frame which is a whole frame;

if the echo zone is present in the current frame:

dividing the current frame into a first section and a second section; and allocating the C bits to the first section and the second section based on a position of the echo zone; and encoding the current frame using the allocated bits, wherein, if the echo zone is present in the first section and the echo zone is not present in the second section:

2C/3 bits are allocated to the first section and C/3 bits are allocated to the second section, or 3C/4 bits are allocated to the first section and C/4 bits are allocated to the second section.

2. The method of claim 1, wherein determining whether or not the echo zone is present includes determining that the echo zone is present in the current frame if energy levels of a voice signal in the sections are not even.

3. The method of claim 2, wherein determining whether or not the echo zone is present includes determining that the echo zone is present in the section in which the transient of the energy level is present when the energy levels of the voice signal in the sections are not even.

4. The method of claim 1, wherein determining whether or not the echo zone is present includes determining that the echo zone is present in a current subframe when normalized energy in the current subframe varies over a threshold value from the normalized energy in a previous subframe.

5. The method of claim 4, wherein the normalized energy is calculated by normalization based on a largest energy value out of energy values in the subframes of the current frame.

6. The method of claim 1, wherein determining whether or not the echo zone is present includes:

sequentially searching subframes of the current frame, and determining that the echo zone is present in a first subframe of which normalized energy is smaller than a threshold value.

7. The method of claim 1, wherein allocating the C bits to the first section and the second section includes:

Allocating the C bits to the first section and the second section based on energy levels and weight values.

8. The method of claim 1, wherein allocating the C bits to the first section and the second section includes:

Allocating the C bits using a bit allocation mode corresponding to the position of the echo zone in the current frame out of predetermined bit allocation modes.

9. The method of claim 8, wherein information indicating the used bit allocation mode is transmitted to a decoder.

10. A voice signal decoding method, the method comprising:

obtaining bits allocation information of a current frame, wherein the bits allocation information is information indicating whether or not an echo zone is present in the current frame;

determining whether or not an echo zone is present in the current frame based on the bits allocation information; and decoding a voice signal based on the determination, wherein:

if the echo zone is not present in the current frame:

the bits allocation information indicates that C bits are allocated to the current frame which is a whole frame, and if the echo zone is present in the current frame:

the bits allocation information indicates that the current frame is divided into a first section and a second section, and the C bits are allocated to the first section and second section based on a position of the echo zone, wherein the echo zone is an area having small energy in a section in which a transient of an energy level is present, wherein if the echo zone is present in the first section and the echo zone is not present in the second section, 2C/3 bits are allocated to the first section and C/3 bits are allocated to the second section, or 3C/4 bits are allocated to the first section and C/4 bits are allocated to the second section.

11. The method of claim 10, wherein the bits allocation information indicates a bits allocation mode used for the current frame in a table in which predetermined bits allocation modes are specified.

12. The method of claim 10, wherein the bits allocation information indicates that bits are differentially allocated to a section in which the echo zone is present and a section in which the echo zone is not present among sections in the current frame.

* * * * *